US008997652B2

(12) United States Patent
Tepera et al.

(10) Patent No.: US 8,997,652 B2
(45) Date of Patent: Apr. 7, 2015

(54) WEAPON AND WEAPON SYSTEM EMPLOYING THE SAME

(71) Applicant: Lone Star IP Holdings, LP, Addison, TX (US)

(72) Inventors: Joseph Edward Tepera, Amarillo, TX (US); Steven D. Roemerman, Highland Village, TX (US)

(73) Assignee: Lone Star IP Holdings, LP, Addison, TX (US)

( * ) Notice: Subject to any disclaimer, the term of this patent is extended or adjusted under 35 U.S.C. 154(b) by 0 days.

(21) Appl. No.: 14/191,667

(22) Filed: Feb. 27, 2014

(65) Prior Publication Data

US 2015/0059609 A1 Mar. 5, 2015

Related U.S. Application Data

(60) Continuation of application No. 13/396,512, filed on Feb. 14, 2012, now Pat. No. 8,661,981, which is a continuation of application No. 12/415,581, filed on Mar. 31, 2009, now Pat. No. 8,127,683, which is a division of application No. 10/997,617, filed on Nov. 24, 2004, now Pat. No. 7,530,315, which is a continuation-in-part of application No. 10/841,192, filed on May 7, 2004, now Pat. No. 8,661,980.

(60) Provisional application No. 60/525,344, filed on Nov. 26, 2003, provisional application No. 60/468,906, filed on May 8, 2003.

(51) Int. Cl.

| | |
|---|---|
| ***F42B 12/60*** | (2006.01) |
| ***F42B 12/44*** | (2006.01) |
| ***F42B 12/36*** | (2006.01) |

(52) U.S. Cl.
CPC ..... *F42B 12/60* (2013.01); *F42B 12/44* (2013.01); *F42B 12/362* (2013.01)

(58) Field of Classification Search
None
See application file for complete search history.

(56) References Cited

U.S. PATENT DOCUMENTS

| | | | |
|---|---|---|---|
| 1,039,850 | A | 10/1912 | Völler |
| 1,077,989 | A | 11/1913 | Maxim |
| 1,240,217 | A | 9/1917 | Ingram |
| 1,312,764 | A | 8/1919 | Straub |
| 1,550,622 | A | 8/1925 | Lesh |

(Continued)

FOREIGN PATENT DOCUMENTS

| | | | |
|---|---|---|---|
| EP | 0 298 494 | A2 | 1/1989 |
| GB | 2280736 | A | 2/1995 |

OTHER PUBLICATIONS

Andersson, O., et al., "High Velocity Jacketed Long Rod Projectiles Hitting Oblique Plates," 19th International Symposium of Ballistics, May 7-11, 2011, pp. 1241-1247, Interlaken, Switzerland.

(Continued)

*Primary Examiner* — Stephen M Johnson
(74) *Attorney, Agent, or Firm* — Boisbrun Hofman, PLLC

(57) ABSTRACT

A weapon and weapon system, and methods of manufacturing and operating the same. In one embodiment, the weapon includes a warhead having an outer casing. The warhead includes a frangible container within the outer casing of the warhead and a destructive element within the frangible container. The destructive element is formed with a non-explosive material. The weapon may also include a guidance section configured to direct the weapon to a target.

20 Claims, 15 Drawing Sheets

(56) References Cited

U.S. PATENT DOCUMENTS 1,562,495 A 11/1925 Dalton
1,765,017 A 6/1930 Marie
2,295,442 A 9/1942 Wilhelm
2,350,140 A 5/1944 Wilton
2,397,088 A 3/1946 Clay
2,445,311 A 7/1948 Cooke et al.
2,621,732 A 12/1952 Ahlgren
2,737,889 A 3/1956 Barker et al.
2,767,656 A 10/1956 Zeamer
2,909,583 A 10/1957 Ortynsky et al.
2,852,981 A 9/1958 Caya
2,911,914 A 11/1959 Wynn et al.
2,934,286 A 4/1960 Kiernan
2,958,260 A 11/1960 Anderson
3,094,934 A 6/1963 Anthony
3,211,057 A 10/1965 White, Jr. et al.
3,242,861 A 3/1966 Reed, Jr.
3,332,348 A 7/1967 Myers, et al.
3,372,890 A 3/1968 Bogard et al
3,377,952 A 4/1968 Crockett
3,379,131 A 4/1968 Webb
3,387,606 A 6/1968 Crafts et al.
3,416,752 A 12/1968 Hembree
3,429,262 A 2/1969 Kincheloe et al.
3,440,963 A 4/1969 Luca
3,541,394 A 11/1970 Brenneman et al.
3,545,383 A 12/1970 Lucy
3,555,826 A 1/1971 Bennett
3,625,106 A 12/1971 Russo et al.
3,625,152 A 12/1971 Schneider, Jr. et al.
3,626,415 A 12/1971 Montgomery et al.
3,635,162 A 1/1972 Lohkamp et al.
3,667,342 A 6/1972 Warnock et al.
3,667,392 A 6/1972 Grantham et al.
3,703,844 A 11/1972 Bleikamp, Jr.
3,712,228 A 1/1973 Handler et al.
3,728,935 A 4/1973 Magorian
3,739,726 A * 6/1973 Pintell ..... 102/215
3,759,466 A 9/1973 Evers-Euterneck
3,763,786 A 10/1973 MacDonald
3,771,455 A 11/1973 Haas
3,786,757 A 1/1974 Goldstein et al.
3,789,337 A 1/1974 Sheppard
3,820,106 A 6/1974 Yamashita et al.
3,872,770 A 3/1975 McGuire
3,887,991 A 6/1975 Panella
3,941,059 A 3/1976 Cobb
3,943,854 A 3/1976 Zwicker
3,954,060 A 5/1976 Haag et al.
3,956,990 A 5/1976 Rowe
3,995,792 A 12/1976 Otto et al.
3,998,124 A 12/1976 Milhous et al.
4,015,527 A 4/1977 Evans
4,036,140 A 7/1977 Korr et al.
4,063,508 A * 12/1977 Whiting ..... 102/393
4,091,734 A 5/1978 Redmond et al.
4,106,726 A 8/1978 Emmons et al.
4,109,579 A 8/1978 Carter
4,112,843 A 9/1978 Laviolette
4,172,407 A 10/1979 Wentink
4,211,169 A 7/1980 Brothers
4,291,848 A 9/1981 Clark
4,364,531 A 12/1982 Knoski
4,383,661 A 5/1983 Ottenheimer et al.
4,408,537 A 10/1983 Fortier
4,430,941 A * 2/1984 Raech et al. ..... 102/496
4,478,127 A 10/1984 Hennings et al.
4,498,394 A 2/1985 Regebro
4,522,356 A 6/1985 Lair et al.
4,616,554 A 10/1986 Spink et al.
4,625,646 A 12/1986 Pinson
4,638,737 A 1/1987 McIngvale
4,648,324 A 3/1987 McDermott
4,709,877 A 12/1987 Goulding
4,714,020 A 12/1987 Hertsgaard et al.
4,744,301 A 5/1988 Cardoen
4,750,404 A 6/1988 Dale
4,750,423 A * 6/1988 Nagabhushan ..... 89/1.51
4,756,227 A 7/1988 Ash et al.
4,770,101 A 9/1988 Robertson et al.
4,775,432 A 10/1988 Kolonko et al.
4,777,882 A * 10/1988 Dieval ..... 102/489
4,803,928 A 2/1989 Kramer et al.
4,824,053 A 4/1989 Sarh
4,834,531 A 5/1989 Ward
4,842,218 A 6/1989 Groutage et al.
4,860,969 A 8/1989 Muller et al.
4,870,885 A 10/1989 Grosselin et al.
4,882,970 A 11/1989 Kovar
4,922,799 A 5/1990 Bartl et al.
4,922,826 A 5/1990 Busch et al.
4,932,326 A 6/1990 Ladriere
4,934,269 A 6/1990 Powell
4,936,187 A 6/1990 Teeter
4,957,046 A 9/1990 Puttock
4,996,923 A 3/1991 Theising
5,027,413 A 6/1991 Barnard
5,034,686 A 7/1991 Aspelin
5,056,408 A 10/1991 Joner et al.
5,088,381 A 2/1992 Lamarque et al.
5,107,766 A 4/1992 Schliesske et al.
5,107,767 A * 4/1992 Schneider et al. ..... 102/393
H1048 H * 5/1992 Wilson et al. ..... 102/496
5,127,605 A 7/1992 Atchison et al.
5,132,843 A 7/1992 Aoyama et al.
5,231,928 A 8/1993 Phillips et al.
5,311,820 A 5/1994 Ellingsen
5,322,998 A 6/1994 Jackson
5,325,786 A 7/1994 Petrovich
5,348,596 A 9/1994 Goleniewski et al.
5,364,290 A 11/1994 Hartmann
5,381,137 A 1/1995 Ghaem et al.
5,413,048 A 5/1995 Werner et al.
5,438,366 A 8/1995 Jackson et al.
5,440,994 A 8/1995 Alexander
5,445,861 A 8/1995 Newton et al.
5,451,014 A 9/1995 Dare et al.
5,461,982 A 10/1995 Boyer
5,467,940 A 11/1995 Steuer
5,529,262 A 6/1996 Horwath
5,541,603 A 7/1996 Read et al.
5,546,358 A 8/1996 Thomson
5,561,261 A 10/1996 Lindstädt et al.
5,567,906 A 10/1996 Reese et al.
5,567,912 A 10/1996 Manning et al.
5,681,008 A 10/1997 Kinstler
5,682,266 A 10/1997 Meyers
5,691,502 A 11/1997 Craddock et al.
5,698,815 A 12/1997 Ragner
5,728,968 A 3/1998 Buzzett et al.
5,796,031 A 8/1998 Sigler
5,816,532 A 10/1998 Zasadny et al.
5,834,684 A 11/1998 Taylor
5,969,864 A 10/1999 Chen et al.
5,978,139 A 11/1999 Hatakoshi et al.
5,988,071 A 11/1999 Taylor
6,019,317 A 2/2000 Simmons et al.
6,021,716 A 2/2000 Taylor
6,105,505 A 8/2000 Jones
6,174,494 B1 1/2001 Lowden et al.
6,216,595 B1 4/2001 Lamorlette et al.
6,253,679 B1 7/2001 Woodall et al.
6,293,202 B1 9/2001 Woodall et al.
6,324,985 B1 12/2001 Petrusha
6,338,242 B1 1/2002 Kim et al.
6,349,898 B1 2/2002 Leonard et al.
6,374,744 B1 4/2002 Schmacker et al.
6,389,977 B1 5/2002 Schmacker et al.
6,523,477 B1 2/2003 Brooks et al.
6,523,478 B1 2/2003 Gonzalez et al.
6,540,175 B1 4/2003 Mayersak et al.
6,546,838 B2 4/2003 Zavitsanos et al.
6,604,436 B1 8/2003 Lewandowski et al.
6,615,116 B2 9/2003 Ebert et al.

(56) References Cited

U.S. PATENT DOCUMENTS

| | | | | |
|---|---|---|---|---|
| 6,666,123 | B1 | 12/2003 | Adams et al. | |
| 6,679,454 | B2 | 1/2004 | Olsen et al. | |
| 6,691,947 | B2 | 2/2004 | La Fata | |
| 6,705,571 | B2 | 3/2004 | Shay et al. | |
| 6,779,754 | B2 | 8/2004 | Hellman | |
| 6,832,740 | B1 | 12/2004 | Ransom | |
| 6,834,835 | B1 | 12/2004 | Knowles et al. | |
| 6,869,044 | B2 | 3/2005 | Geswender et al. | |
| 6,871,817 | B1 | 3/2005 | Knapp | |
| 6,880,780 | B1 | 4/2005 | Perry et al. | |
| 6,910,661 | B2 | 6/2005 | Dockter et al. | |
| 6,933,877 | B1 | 8/2005 | Halladay et al. | |
| 7,019,650 | B2 | 3/2006 | Volpi et al. | |
| 7,032,858 | B2 | 4/2006 | Williams | |
| 7,051,974 | B2 | 5/2006 | Stuhr | |
| 7,083,140 | B1 | 8/2006 | Dooley | |
| 7,121,210 | B2 | 10/2006 | Steele | |
| 7,143,698 | B2 | 12/2006 | Lloyd | |
| 7,156,347 | B2 | 1/2007 | Lam et al. | |
| 7,221,847 | B2 | 5/2007 | Gardiner et al. | |
| 7,325,769 | B1 | 2/2008 | Harnisch et al. | |
| 7,340,986 | B1 | 3/2008 | Gaigler | |
| 7,474,476 | B2 | 1/2009 | Ueta et al. | |
| 7,501,948 | B2 | 3/2009 | Roemerman et al. | |
| 7,503,527 | B1 | 3/2009 | Fairchild | |
| 7,530,315 | B2 | 5/2009 | Tepera et al. | |
| 7,690,304 | B2 | 4/2010 | Roemerman et al. | |
| 7,789,343 | B2 | 9/2010 | Sarh et al. | |
| 7,895,946 | B2 | 3/2011 | Roemerman et al. | |
| 7,958,810 | B2 | 6/2011 | Roemerman et al. | |
| 8,016,249 | B2 | 9/2011 | Sar et al. | |
| 8,042,471 | B2 | 10/2011 | Michel et al. | |
| 8,049,869 | B2 | 11/2011 | Flowers et al. | |
| 8,127,683 | B2 | 3/2012 | Tepera et al. | |
| 8,502,126 | B2 | 8/2013 | Tyree | |
| 8,541,724 | B2 | 9/2013 | Roemerman | |
| 8,661,980 | B1 | 3/2014 | Roemerman et al. | |
| 8,661,981 | B2 * | 3/2014 | Tepera et al. | 102/495 |
| 2003/0051629 | A1 | 3/2003 | Zavitsanos et al. | |
| 2003/0056680 | A1 | 3/2003 | Santacreu | |
| 2003/0123159 | A1 | 7/2003 | Morita et al. | |
| 2003/0146342 | A1 | 8/2003 | Hellman | |
| 2003/0192992 | A1 | 10/2003 | Olsen et al. | |
| 2004/0174261 | A1 | 9/2004 | Volpi et al. | |
| 2005/0127242 | A1 | 6/2005 | Rivers, Jr. | |
| 2005/0180337 | A1 | 8/2005 | Roemerman et al. | |
| 2005/0201450 | A1 | 9/2005 | Volpi et al. | |
| 2005/0274844 | A1 | 12/2005 | Stuhr | |
| 2006/0017545 | A1 | 1/2006 | Volpi et al. | |
| 2006/0077036 | A1 | 4/2006 | Roemerman et al. | |
| 2006/0198033 | A1 | 9/2006 | Soyama et al. | |
| 2007/0035383 | A1 | 2/2007 | Roemerman et al. | |
| 2007/0157843 | A1 | 7/2007 | Roemerman et al. | |
| 2008/0062412 | A1 | 3/2008 | Kravitz | |
| 2009/0026321 | A1 | 1/2009 | Sarh et al. | |
| 2009/0078146 | A1 | 3/2009 | Tepera et al. | |
| 2009/0100995 | A1 | 4/2009 | Fisher | |
| 2009/0228159 | A1 | 9/2009 | Flowers et al. | |
| 2009/0283643 | A1 | 11/2009 | Sar et al. | |
| 2010/0031841 | A1 | 2/2010 | Michel et al. | |
| 2010/0264253 | A1 | 10/2010 | Taylor et al. | |
| 2010/0282893 | A1 | 11/2010 | Roemerman et al. | |
| 2010/0326264 | A1 | 12/2010 | Roemerman et al. | |
| 2011/0108660 | A1 | 5/2011 | Roemerman et al. | |
| 2011/0179963 | A1 | 7/2011 | Tepera et al. | |
| 2011/0233322 | A1 | 9/2011 | Holicki et al. | |
| 2012/0199689 | A1 | 8/2012 | Burkland | |
| 2012/0292431 | A1 | 11/2012 | Patel et al. | |
| 2014/0026777 | A1 | 1/2014 | Tepera et al. | |
| 2014/0060375 | A1 | 3/2014 | Roemerman et al. | |

OTHER PUBLICATIONS

Davitt, R.P., "A Comparison of the Advantages and Disadvantages of Depleted Uranium and Tungsten Alloy as Penetrator Materials," Tank Ammo Section Report No. 107, Jun. 1980, 32 pages, U.S. Army Armament Research and Development Command, Dover, NJ.

"DOE Handbook: Primer on Spontaneous Heating and Pyrophoricity," Dec. 1994, 87 pages, DOE-HDBK-1081-94, FSC-6910, U.S. Department of Energy, Washington, D.C.

Rabkin, N.J., et al., "Operation Desert Storm: Casualties Caused by Improper Handling of Unexploded U.S. Submunitions," GAO Report to Congressional Requestors, Aug. 1993, 24 pages, GAO/NSIAD-93-212, United States General Accounting Office, Washington, D.C.

Smart, M.C. et al., "Performance Characteristics of Lithium Ion Cells at Low Temperatures," IEEE AESS Systems Magazine, Dec. 2002, pp. 16-20, IEEE, Los Alamitos, CA.

"UNICEF What's New?: Highlight: Unexploded Ordnance (UXO)," http://www.unicef.org.vn/uxo.htm, downloaded Mar. 8, 2005, 3 pages.

* cited by examiner

WEAPON AND WEAPON SYSTEM EMPLOYING THE SAME

This Application is a continuation of U.S. patent application Ser. No. 13/396,512 entitled "Weapon and Weapon System Employing the Same" filed on Feb. 14, 2012, now U.S. Pat. No. 8,661,981, issued Mar. 4, 2014, which is a continuation of U.S. patent application Ser. No. 12/415,581 entitled "Weapon and Weapon System Employing the Same," filed on Mar. 31, 2009, now U.S. Pat. No. 8,127,683, issued Mar. 6, 2012 which is a divisional of U.S. patent application Ser. No. 10/997,617 entitled "Weapon and Weapons System Employing the Same," filed Nov. 24, 2004, now U.S. Pat. No. 7,530,315, issued May 12, 2009, which is a continuation-in-part of U.S. patent application Ser. No. 10/841,192 entitled "Weapon and Weapon System Employing the Same," filed May 7, 2004, now U.S. Pat. No. 8,661,980, issued Mar. 4, 2014, which claims benefit of U.S. Provisional Application No. 60/468,906 entitled "Weapon System, Warhead and Weapons Design for Increased Mission Effectiveness and Decreased Collateral Damage," filed May 8, 2003, and also claims the benefit of U.S. Provisional Application No. 60/525,344 entitled "Kinetic Energy Warheads having Selective Effects, Limited Collateral Damage and Minimal Hazardous Debris," filed Nov. 26, 2003, which applications are incorporated herein by reference.

TECHNICAL FIELD

The present invention is directed, in general, to weapon systems and, more specifically, to a weapon and weapon system, and methods of manufacturing and operating the same.

BACKGROUND

War fighting capabilities and methods have slowly evolved over the period of the twentieth century. One of many improvements has been a significant advance in the ability to deliver a weapon with great accuracy. Weapon delivery with zero or near zero circular error of probability [also referred to as circular error probable ("CEP")] is almost the norm when the weapon is equipped with precision guidance capabilities.

In the military science of ballistics, circular error of probability is a simple measure of a weapon system's precision. The impact of munitions near the target tends to be normally distributed around the aim point with progressively fewer munitions located about the aim point at a greater distance away. A mathematician might characterize this pattern by its standard deviation, but a more intuitive method is to state the radius of a circle within which 50 percent of the rounds will land.

This movement for greater accuracy has been encouraged by the war fighter communities and has been made possible by technology growth. The World War I, World War II, Korean and Vietnam era warfare witnessed the application of massive use of unguided weapons with large chemically based explosive warheads. This approach was permitted because the size of the boundaries of the total set of acceptable targets was virtually unlimited (i.e., unlimited war) and the zone impacted by the chemically based warhead blast and shrapnel was normally within the CEP.

The geopolitical nature of warfare, however, has significantly evolved throughout the twentieth century and continues into the twenty first century. More specifically, changes in the set of all features that may form the list of acceptable targets has been driven by various influences. By way of example, FIG. 1 qualitatively illustrates a graphical representation of a target spectrum over the course of the twentieth century and the trend into the twenty first century.

The graphical representation of FIG. 1 includes a total set of features and objects that represents potential targets that may be subject to bombardment by a weapon. The total set may be subject to attack provided that there are no constraints such as technical, political, humanitarian, military or others. In reality, during the course of military history and especially in the twentieth century, the total set of features and objects has been reduced. Targets to the right of Line A are features and objects sensitive for political and humanitarian reasons. The targets sensitive for political and humanitarian reasons are exempt from attack without regard to any technical ability of any weapon or weapon system. For instance, the targets such as hospitals and religious shrines are adverse to collateral damage and off limits to long term lethal debris.

In a similar manner, features and objects above Line 1 are generally exempt from bombardment, not because of being unworthy, but because of technical, military or similar limitations or constraints. While the targets above Line 1 are often high value targets of military worthiness, the targets are hardened to attack with conventional weapons and often require ground attack or nuclear weapons. An example of early targets that fall within this region include well fortified bunkers such as bunkers designed by the Germans in World War II.

Thus, the set of targets that may be attacked by precision weapons incorporating chemically explosive warheads or lethal devices is reduced to that area enclosed by Line A and Line 1 of the target spectrum. Furthermore, in the late twentieth century the impact of social and political influences has given impulse to reducing the available set of targets by targeting constraints (to the left of Line B) and targets with low military value (below Line 2). The impact of the twenty first century influences (represented by Line B and Line 2) have further reduced the target region as defined by the twentieth century boundaries (represented within Line A and Line 1).

A strong contribution to the reduction of the target region has been the great improvement in guidance with the associated pin-point accuracy of the weapons (i.e., the exceedingly smaller CEP). The results of the blast and shrapnel region generated with a typical chemically based explosive often extends beyond the CEP. In contrast, there are some lightly defended targets which are not "hard," but are simply of too little value to merit an individual attack. For example, a single tent would not be targeted in most of the conflicts of the twentieth century, unless it was associated with some other target such as an observation position or a command and control post. These targets, which are of too little value to warrant individual attention are represented below Line 2 in FIG. 1.

Likewise, there are some targets that require targeting and guidance beyond the capability of the war fighter. Prior to the advent of laser guided bombs, even relatively large targets, such as bridges, fell into this category when local defenses made low level bombing impossible. In Vietnam, some bridges were attacked with literally thousands of bombs without lasting effect, because the strike aircraft simply could not get close enough without exposure to great danger to place a bomb on a critical structural location. Most of these bridges were subsequently destroyed with the first attack by aircraft with laser guided bombs. These targets, which are not susceptible to attack because of the lack of adequate targeting information or due to lack of weapon placement precision, are shown to the left of Line B in FIG. 1.

Thus, with the growth of technical and political sophistication, social demands and economic pressures on war planners, a number of factors have changed the permissible target spectrum. Under these influences, the permissible set has shrunk while the innovative application of improved weapon systems has had the effect of expanding the target region. The net effect, however, is that the areas of growth have been more than offset by the areas lost.

There has been some modest growth in the target region below Line 1. For instance, bunker busters and other weapons have given strike planners the ability to strike harder targets. The term "bunker buster" is a generic term that generally applies to weapons that have the capacity to penetrate into targets that are deeply buried under ground, protected by thick layers of highly resistive materials such as concrete, and targets that are protected by considerable thickness (tens of meters) of overgrowth (e.g., earth, sand, or other natural material) prior to detonation of the explosive charge. The hardness beyond the capability of conventional weapons, however, is still on the order of tens of meters of concrete, and the absolute number of such targets is very small. Thus, changes in the boundary defined by Line 1 have an insufficient influence on the absolute number of targets that can be attacked.

Precision guidance and targeting by means of sophisticated sensors and intelligence tools has created a "zero CEP weapon." It is now practical to assume that many weapons will "miss" their target by, for instance, inches, which is for nearly all purposes the same thing as a zero CEP. Thus, the area left of Line B has become smaller. While the improvement in technology has had some influence on the number of targets that can be attacked and has increased the target region somewhat, it has mostly changed the method of attack.

The area below Line 2 has become quite small. As non-state enemies have emerged as a threat, it has become necessary to target small soft targets such as individual automobiles or a single tent. This boundary shift has increased the target region somewhat, but the absolute number of targets that can be attacked has not been strongly influenced. At the same time, the area to the right of Line A has grown and, with conventional warheads, the blast radius is simply too large to allow most general purpose weapons to be used. This is the dominant effect in the rules of engagement for many conflicts of recent years. Foes who understand the political considerations of rules of engagement can protect their assets by locating them near, for instance, shrines, schools, and hospitals.

A couple of other factors should be recognized in accordance with the target spectrum of FIG. 1. First, a number of the targets are "too soft." In other words, these targets are not susceptible to most forms of attack due to their lack of substance. A contact fuze will not generally function when a weapon contacts a tent. At shallow flight path angles, the weapon will simply pass through the tent, and will explode at some distance away. This problem is also seen with high velocity penetrators. In prior conflicts, the preferred means to attack soft targets was area munitions which may be a concussion weapon with a large blast radius of effectiveness, or a cluster weapon dispensing a large number of small explosives with very sensitive contact fuzes. These means are not generally acceptable for political reasons and the resulting unacceptable collateral damage.

Another factor is the need for flexibility. The nature of war has become much more dynamic and ad hoc as it applies to strike missions. In recent conflicts, the majority of strike platforms (e.g., ships, aircraft, troops, armored vehicles) did not know what specific targets with which they were to engage at the time of selecting munitions loading. Thus, the weapons carried to the conflict had to be general purpose, and it was highly desirable to have the effects of the weapons selectable to match both the target characteristics and the rules of engagement. In the process of prosecuting a campaign, matching weapons, targets, and rules of engagement is often impossible. As an example, Javelin (an anti-tank weapon) has been used to attack suburban structures, which is an inefficient match for the Javelin fuze and warhead. As a further example, cluster weapons have been used near civilian areas, resulting in injury to civilians who subsequently found unexploded ordnance. As yet a further example, Hellfire missiles (another anti-tank weapon) have been used to attack light trucks; a mismatch for the Hellfire fuze and warhead, which in some cases resulted in a failure to explode. In many other cases, the rules of engagement prevented a needed attack from being prosecuted, primarily due to the risk of collateral damage.

Thus, in some conflicts, the absolute space of targets has factually diminished. The change in war fighting methods and capabilities has not kept pace with this change in philosophy. The military continues to depend upon large chemically based explosives and cluster bombs with submunitions. Although precision guidance has offered a limited measure of performance gain to match these changes in philosophy, warhead and munitions characteristics continue to produce collateral damage, scatter latent lethal debris, and generate unacceptable over-kill.

A large class of warheads now used by various military establishments, including the United States Department of Defense, depends upon the conversion of certain chemical compounds into thermal energy, with dynamic pressure differentials and kinetic energy imparted to elements of the warhead (e.g., shrapnel) to produce lethal effects and destruction of a target. A proportion of this class of warheads contain the chemical compounds as a unified mass within a casing, also referred to as a unitary warhead. The substantial thermal effects, differential pressures and shrapnel of the unitary warhead can encompass a large area producing damaging effects to an area that exceeds that of the intended target thereby giving rise to the potential of inducing collateral damage. Additionally, unexploded unitary warheads (a class of unexploded ordnance) present a significant latent hazard. Intended and unintended motion, shock and impact imparted to or in proximity of an unexploded warhead can cause detonation with unintended damage, destruction, injury and death. Occurrences of the detonation of unexploded unitary warheads dating from World War I and World War II have been noted by the United Nations studies (see, for instance, www.unicef.org.vn/uxo.htm).

Another portion of warheads contain the chemical compounds in a substantially smaller container, herein referred to as submunitions, and of which multiple submunitions are packaged into a larger container. The submunitions are dispensed at the target to achieve lethal effects over an area. Dispensed submunitions, though effective, produce a certain number that fail to detonate for any number of reasons. These unexploded submunitions (a class of unexploded ordnance) present a latent hazard and collateral damage. Unexploded submunitions are known to detonate, causing severe injury and loss of life, when subjected to motion, shock and impact such as the motion, shock and impact that may be induced by the action of a person picking up the unexploded submunitions and then having it detonate. Additionally, unexploded submunitions present a hazard to one's own personnel that move through the area where the weapon has been dispensed, often present to remove and clear a dispensed area. The unexploded submunitions also present a hazard to innocent individuals that come into contact with the submunitions. Organizations and certain individuals have represented that the submunitions are equivalent to landmines and represent an unacceptable, dangerous element to society.

Another portion of warheads rely upon kinetic energy by way of substantial velocity imparted to dense materials properly shaped into suitable projectiles of sub-caliber and full-caliber dimensions to penetrate targets, also referred to as penetrating projectiles. Thermal effects, shrapnel and differential pressure are introduced into the target being derived from the high kinetic energy of the mass of the penetrating projectile. A portion of these penetration projectiles are typically formed from depleted uranium. Another portion of these penetrating projectiles are typically formed from shaped charges utilizing alloys of copper in a shaping cone. In current practice, the warheads employ velocities on the order of 5,000 feet per second for depleted uranium and 26,000 feet per second for shaped copper cones to achieve the intended effects on a target. Residual dust and debris from these weapons can carry latent effects that may be harmful.

Social organizations, such as the Campaign Against Depleted Uranium, have represented that there are latent dangers of depleted uranium to the health of the general population and to war fighters in particular. These dangers are latent, occurring well after the warhead has been expended or exposed to destabilizing environments such as a fire. It has been demonstrated that each of these types of warheads have sufficient chemical energy and kinetic energy to destroy the targets engaged, produce collateral damage beyond the area of the target, scatter hazardous debris in the form of depleted uranium dust and fragments, and to distribute a large number of unexploded submunitions, or even a single substantial unexploded unitary warhead.

By way of example, a shaped charge anti-armor warhead having a copper cone liner of a half pound traveling at a hypersonic velocity of 26,000 feet per second will penetrate 300 millimeters of roll hardened armor and has kinetic energy on the order of:

$$K.E.=\tfrac{1}{2}(0.5/32.2)*(26{,}000)^2=5.25\times10^6 \text{ ft-lbs},$$

wherein the kinetic energy ("K.E.")$=\tfrac{1}{2}\,mv^2=\tfrac{1}{2}(w/G)v^2$. In each of the computations herein, weight (w) is provided in units of pounds force, acceleration of gravity (G) is provided in units of feet per second and speed (v) is provided in units of feet per second resulting in kinetic energy with units of foot-pounds. A portion of the penetration capability of a shaped charge is produced by the very high temperature of the jet of gases formed by chemical explosive, on the order of thousands of degrees Fahrenheit, which drives the deformed copper liner into the armor.

A depleted uranium armor piercing projectile of ten pounds traveling at a velocity of 5,000 feet per second will pass completely through the turret of a main battle tank and has kinetic energy on the order of:

$$K.E.=\tfrac{1}{2}(10/32.2)*(5000)^2=3.88\times10^6 \text{ ft-lbs}.$$

Continuing this example, by comparison, a guided bomb of 2000 pounds traveling above sonic velocity at 1392 feet per second has kinetic energy on the order of:

$$K.E.=\tfrac{1}{2}(2000/32.2)*(1392)^2=60.18\times10^6 \text{ ft-lbs}.$$

By way of comparison of the kinetic energy in the results of the guided bomb as compared to the results of the shaped charge and depleted uranium projectile, the guided bomb has a multiple of 11 to 15 or more times the kinetic energy. The kinetic energy of a guided 2000 pound bomb has the capability to penetrate several meters of reinforced concrete before the chemical explosive bursting charge detonates.

Destruction or neutralization of a target depends upon both the successful application of a warhead of sufficient energy, the ability to place the warhead on or within a suitable distance of the target and the fuzing of the warhead. Application of an oversized warhead when placed within an acceptable distance of the target will normally result in the destruction or neutralization of the target. This substantially increases the opportunity to cause undesired and unnecessary collateral damage beyond the space occupied by the target. Application of a warhead of insufficient size normally results in a failed attempt to destroy or neutralize the target, and these results may be independent of the placement of the warhead. For purposes of illustration, a nuclear warhead placed and detonated in close proximity to a main battle tank will result in the destruction of the tank. The collateral damage from the application would be extensive. In contrast, a bullet fired from a side arm (e.g., a pistol) would not likely destroy or neutralize a main battle tank, but there would be almost no collateral damage.

In a like manner, placement of the warhead significantly influences the results achieved. The greater the precision of placement of a warhead with respect to the target, the smaller the warhead that can be employed to achieve acceptable levels of destruction or neutralization of the target. Increased precision of warhead placement also reduces the opportunity for collateral damage. Political demands, ethical considerations, social influences and economic constraints on the rules of engagement are such that collateral damage is undesirable. Likewise, a large class of targets that are now encountered in current scenarios can be successfully defeated with smaller warheads with improved placement provided that the target detectors and warhead fuzing can suitably interpret target information such as location, motion and physical characteristics.

The vast multitude of targets that may be encountered in a given scenario requires a large matrix of warheads. Additionally, variability in target characteristics has lead to an introduction of a large number of diverse target sensors. Also, lasers, radar, multi-millimeter wave, infrared signals, geometric characteristics, acoustics noises, physical location and other methods are used to provide guidance and fuzing information to a warhead. This multi-parameter matrix of warheads, guidance systems, and rules of engagement results in a logistically difficult and large solution space to be properly managed so as to result in the effective destruction of the intended target without unacceptable collateral damage.

Current warhead technology is typically embodied in single effect munitions and does not incorporate a method of selectively varying effects. To be able to engage a large matrix of targets effectively requires a large mix of warheads. Limited magazine space and transportation capacity results in limited numbers of a given class of warheads or a limited mix of classes being available at the operating units. The available warhead load-out is limited by the possible warhead characteristics. Armed units entering a combat situation not having full knowledge of potential target characteristics or assigned a target-of-opportunity role typically elect to arm with warheads that yield the larger effects. The potential for mismatch between the target to be confronted and the load-out of the engaging unit is considerable. Thus, load-outs will tend to err on the side of larger warheads. Larger warheads affect larger areas and, in general, greatly increase the chances of collateral damage.

For purpose of example, consider an air-to-ground, guided missile ("AGM") such as an AGM-154 configured with 145 submunitions (i.e., bomblets) dispensing the submunitions over an area as large as or larger than that of a football field. A percentage of dispensed submunitions (typically three to seven percent) fail to function resulting in a large number of unexploded submunitions creating hazards to friendly troops moving through the area, to innocent civilians, and to personnel removing the unexploded submunitions.

As an additional example, consider the application of a guided bomb unit ("GBU") such as a GBU-28 (a precision-guided weapon with a 2000 pound class unitary warhead) to a civilian style structure embedded within a neighborhood. This type of warhead will generate collateral damage beyond the confines of the target engaged. Also, a GBU-28 that has been delivered but has failed to explode and may be subject to unintended motion, shock or impact presents a very significant latent hazard.

As a further example, consider the engagement of a non-armor vehicle or a civilian vehicle with a Hellfire missile. The blast energy far exceeds what is necessary to destroy that vehicle. Alternatively, a depleted uranium enhanced tank round would pass completely through the target and may not destroy or even seriously disable the target while at the same time producing unintended damage or destruction of unintended objects or individuals beyond the target.

It would be advantageous, therefore, to employ a warhead, weapon and weapon system that increases the size of the set of objects and features that is available for targeting. That is, weapons that augment the magnitude of the target region of FIG. 1. A weapon that can utilize the advantages of precision guidance and that has selectable effects with sufficient kinetic energy to destroy, neutralize or impair the selected target without substantially inducing either collateral damage or depositing hazardous debris or elements that have lingering latent injurious effects would be very advantageous. It would further be beneficial to deploy a warhead that detonates in a manner such that no or little conditions of unexploded ordnance occur. In the case of a weapon with little or no chemical explosives, the warhead can be used to attack a very wide spectrum of soft and hard targets and, in particular, attack targets that currently defy contact fuzing. The zone affected by the action of the warhead should remain within the impact area and within the CEP, and the existence of ancillary unexploded ordnance should be reduced.

Those skilled in the art appreciate that unitary warheads, submunitions and penetrating projectiles are packaged in a multitude of different shapes and containers thereby producing warheads that are compatible with many different methods of delivery such as, but not limited to, artillery shells, aircraft free fall bombs, guided and unguided rockets. Even in view of the flexibility, however, several limitations still apply to the application of such weapons such as a limited target set, collateral damage beyond the intended target, the production of residual latent dangerous and hazardous materials and debris including, but not limited to, unexploded ordnance, and the inability to select different effects from a single warhead.

Accordingly, what is needed in the art is an effective weapon and warhead that is adequate for the mission and very limited and specific to its area of intended destruction. The destructive force of the warhead should be confined to the intended target without inflicting damage to adjacent and non targeted structures, features, and innocent personnel. Additionally, the warhead should be substantially insensitive to stressing environments to significantly reduce the exposure to inadvertent explosion.

SUMMARY OF THE INVENTION

These and other problems are generally solved or circumvented, and technical advantages are generally achieved, by advantageous embodiments of the present invention which includes a weapon and weapon system, and methods of manufacturing and operating the same. In one embodiment, the weapon includes a warhead having an outer casing. The warhead includes a frangible container within the outer casing of the warhead and a destructive element within the frangible container. The destructive element is formed with a non-explosive material. The weapon may also include a guidance section configured to direct the weapon to a target.

In another aspect, the present invention provides a method of manufacturing a weapon. The method includes providing a warhead having an outer casing, and forming a frangible container having a forward closure (also referred to as "front closure") and an aft bulkhead. The method also includes forming a destructive element with a non-explosive material and placing the destructive element within the frangible container. The method still further includes placing the frangible container within the outer casing of the warhead.

In another aspect, the present invention provides a weapon system including a delivery vehicle and a weapon couplable to the delivery vehicle. The weapon includes a warhead having an outer casing and including a frangible container within the outer casing. The warhead also includes a destructive element within the frangible container and formed with a non-explosive material. The weapon also includes a guidance section configured to direct the weapon to a target.

In a related, but alternative embodiment, the present invention provides a method of operating a weapon system. The method includes deploying a weapon from a delivery vehicle. The weapon includes a warhead with an outer casing and a frangible container within the outer casing with a destructive element therein. The destructive element is formed with a non-explosive material. The method also includes guiding the weapon toward a target and inducing the frangible container and the destructive element to exit an opening in the outer casing of the warhead to penetrate the target.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
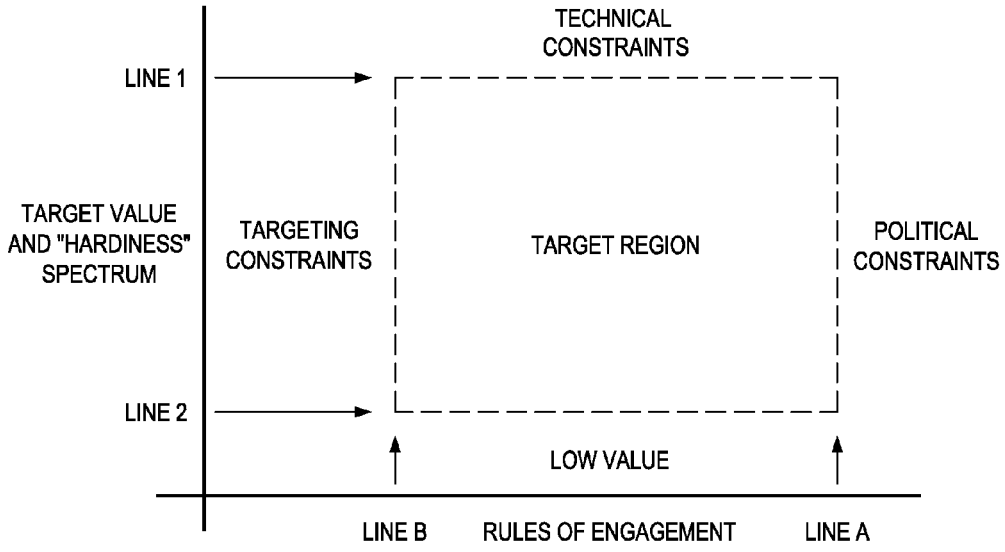
FIG. 1 illustrates a graphical representation of a target spectrum for a weapon over the course of the twentieth century and the trend into the twenty-first century.

The limitations as described above (see, for instance, the description with respect to FIG. 1) are generally solved and circumvented and technical advantages are generally achieved by advantageous embodiments of the present invention, including a weapon design with a warhead that employs the transfer of kinetic energy into the intended target for the purposes of destruction, a warhead with, in an exemplary embodiment, little or no explosive or hazardous materials, a warhead that fragments into lethal shrapnel and incendiary debris from kinetic energy transfer at impact, a warhead that incorporates features that permit selectivity in warhead performance, and a warhead that has a means of detonation beyond the normal fuzing to eliminate or reduce the possibility of unexploded ordnance for substantial chemical unitary warheads.

The weapon and weapon system provides a mechanism to select variable effects at a target and substantially limit collateral damage. This is accomplished by utilizing kinetic energy to produce a desired effect with little, or no chemical component. In accordance therewith, very low unexploded ordnance statistics result from a warhead constructed according to the principles of the present invention. The warhead is compatible with existing warhead envelopes of size, shape, weight, center of gravity, moments of inertia and structural strength to reduce, or avoid, lengthy and expensive qualification for use with manned platforms such as ships, helicopters, airplanes of both fixed-wing characteristics and vertical/short take-off and landing characteristics, both prime mover towed and self-propelled artillery, thereby resulting in warheads, weapons and methods for introducing the warheads more quickly and at less expense.

The geopolitical, strategic, tactical, humanitarian and similar effects that tend to reduce the total target region because of the accumulated effects of large CEPs characteristic of unguided munitions, chemically based explosive warheads, and latent effects of non-functioning portions of the warheads as discussed above are addressed by the weapon and weapon system including the kinetic energy warheads as set forth herein. The present invention will be described with respect to preferred embodiments in a specific context, namely, a weapon and weapon system that increases mission effectiveness and decreases collateral damage. As discussed herein, the weapon includes a warhead with variability of types and effects, limited or reduced collateral damage, non-lethal debris and residue after expenditure thereof, and more precise control of warheads and their effects. In accordance therewith, the weapon provides a substantial reduction of collateral damage by use of kinetic energy warheads as primary warheads and kinetic energy elements as ancillary devices within conventional warheads.

Figure 2:
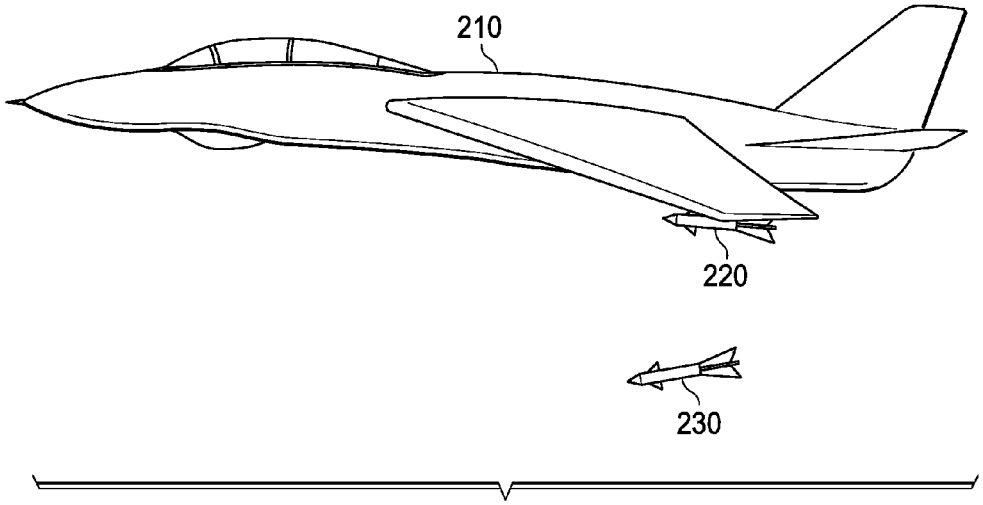
FIG. 2 illustrates a view of an embodiment of a weapon system in accordance with the principles of the present invention.

Referring now to FIG. 2, illustrated is a view of an embodiment of a weapon system in accordance with the principles of the present invention. The weapon system includes a delivery vehicle (e.g., an airplane such as an F-14) 210 and at least one weapon. As demonstrated, a first weapon 220 is attached to the delivery vehicle and a second weapon 230 is deployed from the delivery vehicle 210 intended for a target.

The weapon system is configured to provide energy as derived, without limitation, from a velocity and altitude of the delivery vehicle 210 in the form of kinetic energy and potential energy to the first and second weapons 220, 230 and, ultimately, the warhead, submunitions and destructive elements (such as darts and shot) therein. The first and second weapons 220, 230 when released from the delivery vehicle 210 provide guided motion for the warhead, submunitions and destructive elements to the target. The energy transferred from the delivery vehicle 210 as well as any additional energy acquired through the first and second weapons 220, 230 through propulsion, gravity or other parameters provides the kinetic energy to the warhead to perform the intended mission. While the first and second weapons 220, 230 described with respect to FIG. 2 represent precision guided weapons, those skilled in the art understand that the principles of the present invention also apply to other types of weapons including weapons that are not guided by guidance technology or systems.

In general, it should be understood that other delivery vehicles including other aircraft may be employed such that the weapons contain significant energy represented as kinetic energy plus potential energy. As mentioned above, the kinetic energy is equal to "½ $mv^2$", and the potential energy is equal to "mgh" where "m" is the mass of the weapon, "g" is gravitational acceleration equal to 9.8 M/$sec^2$, and "h" is the height of the weapon at its highest point with respect to the height of the target. Thus, at the time of impact, the energy of the weapon is kinetic energy, which is directed into and towards the destruction of the target with little to no collateral damage of surroundings. This is due to the absence of an explosive charge, in a preferred embodiment, which destroys a target by significant over pressure and high temperature due to the explosive effects of the warhead. Unfortunately, this chemically explosive effect also causes considerable damage to surroundings as well.

Turning now to FIGS. 3A-3D, illustrated are sequential diagrams demonstrating the benefits associated with deploying an embodiment of a weapon 310 constructed according to the principles of the present invention. Beginning with FIG. 3A, a target (represented by the truck) 320 is in close proximity to a non-target structure 330. When deploying the weapon 310, the objective is to destroy the target 320 without providing collateral damage to the non-target structure 330. Furthermore, it is an objective to avoid leaving behind lethal and latent debris as the weapon 310 expends its destructive force on the target 320.

Figure 3A:
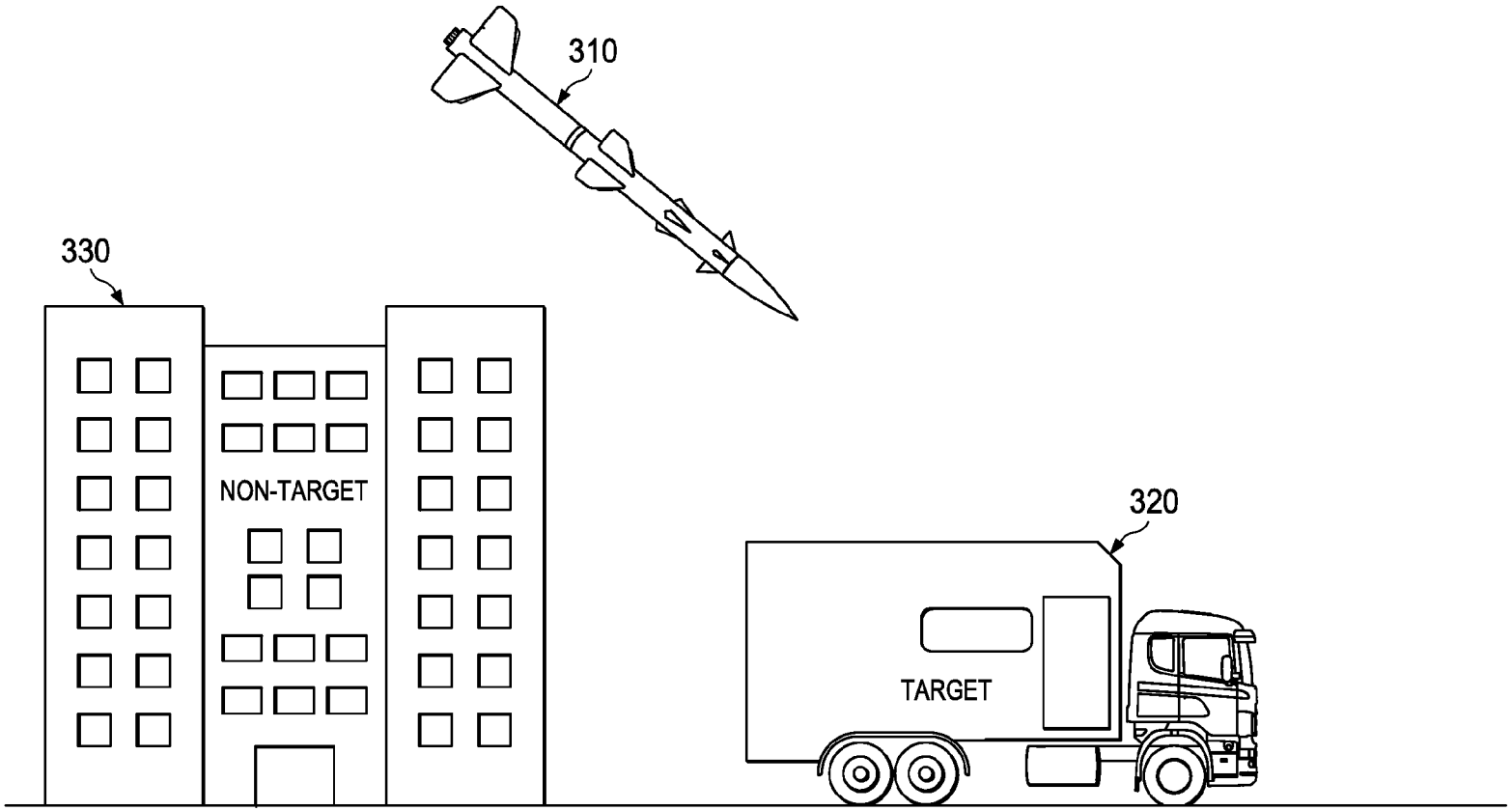
FIGS. 3A-3D illustrate sequential diagrams demonstrating the benefits associated with deploying an embodiment of a weapon constructed according to the principles of the present invention.
Figure 3B:
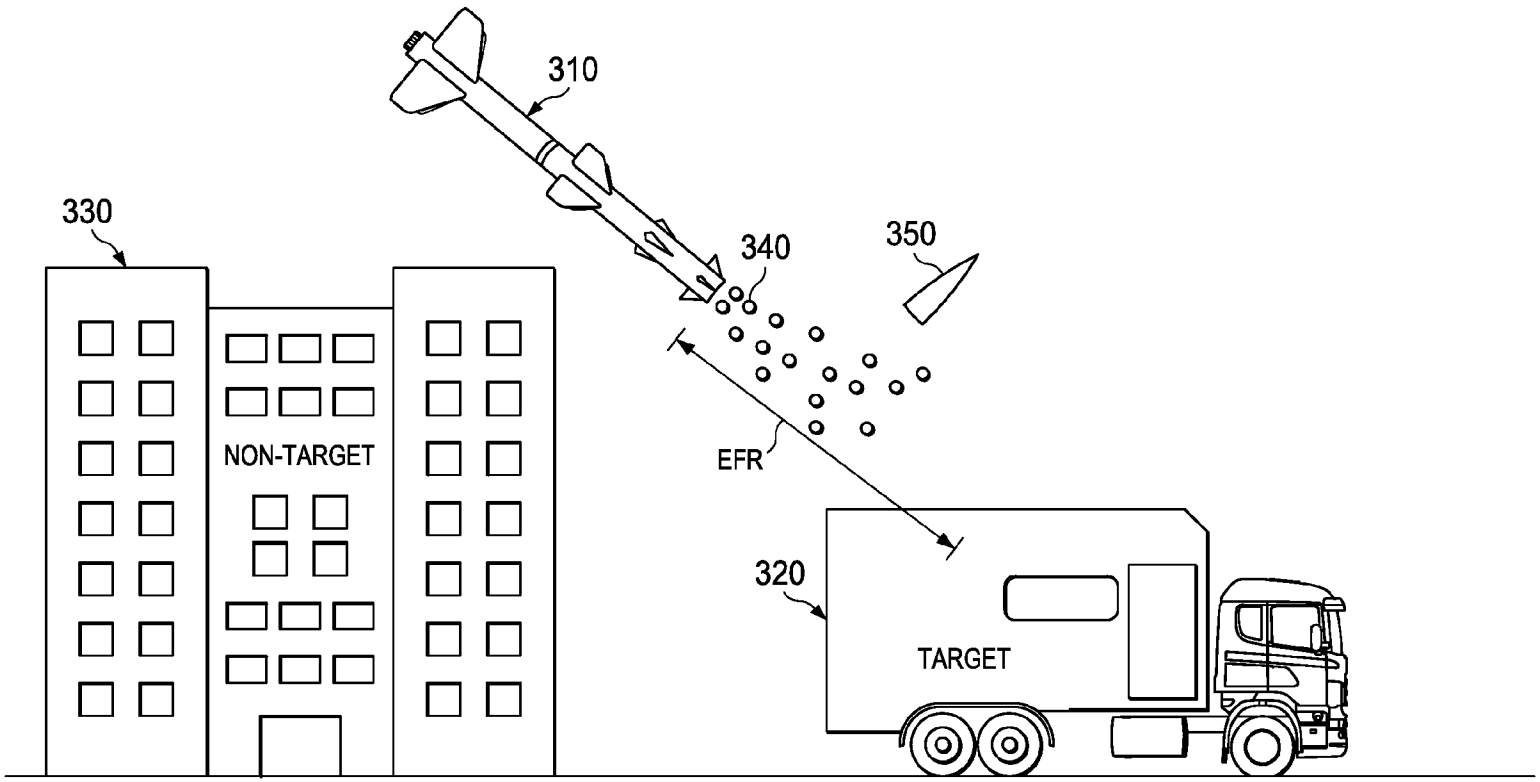

Turning now to FIG. 3B, a plurality of destructive elements (e.g., shot, one of which is designated 340) are dispensed from the warhead of the weapon 310. The destructive elements 340 are dispersed in a predetermined pattern and at some predetermined effective range (generally designated "EFR") against the target 320 so as to affect the target 320 in a desired manner. The destructive elements 340 have a degree of kinetic energy by virtue of their individual mass and velocity. Further, a guidance member 350 may shape a pattern of the destructive elements 340, for example, by controlling a path, trajectory, degree of dispersion, and other functional parameters of the destructive elements 340. The release of the destructive elements 340 is accomplished such that the non-target structure 330 remains substantially undamaged and suffers little or no collateral damage.

Figure 3C:
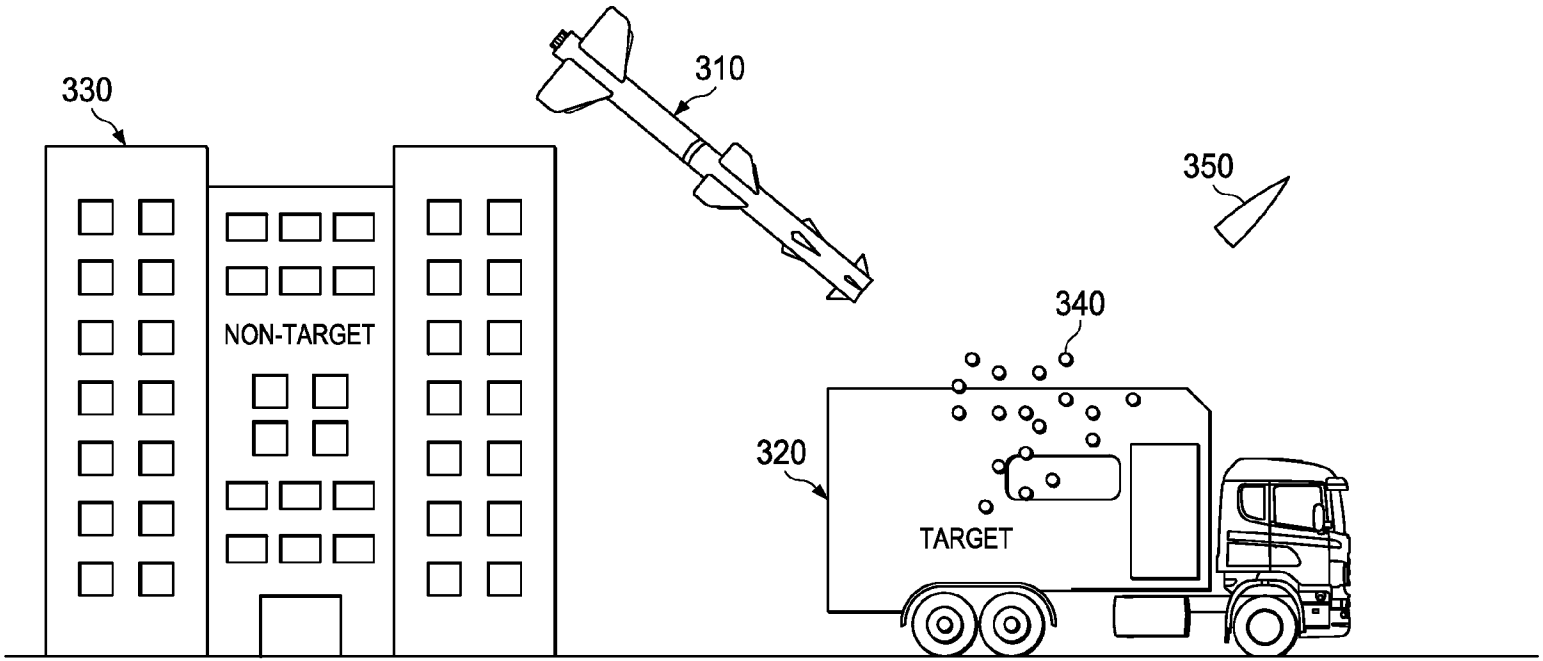

Turning now to FIG. 3C, the destructive elements 340 have impacted the target 320 and expended kinetic energy by way of destruction and damage thereto. The remaining sections of the weapon 310 including the guidance member 350 are shown clear of the non-target structure 330. Although in the illustrated embodiment a single article (in this case, the guidance member 350) is separated from the remaining portion of the weapon 310, those skilled in the art will recognize that the weapon may separate into a plurality of sections and components to achieve differing desired effects.

Figure 3D:
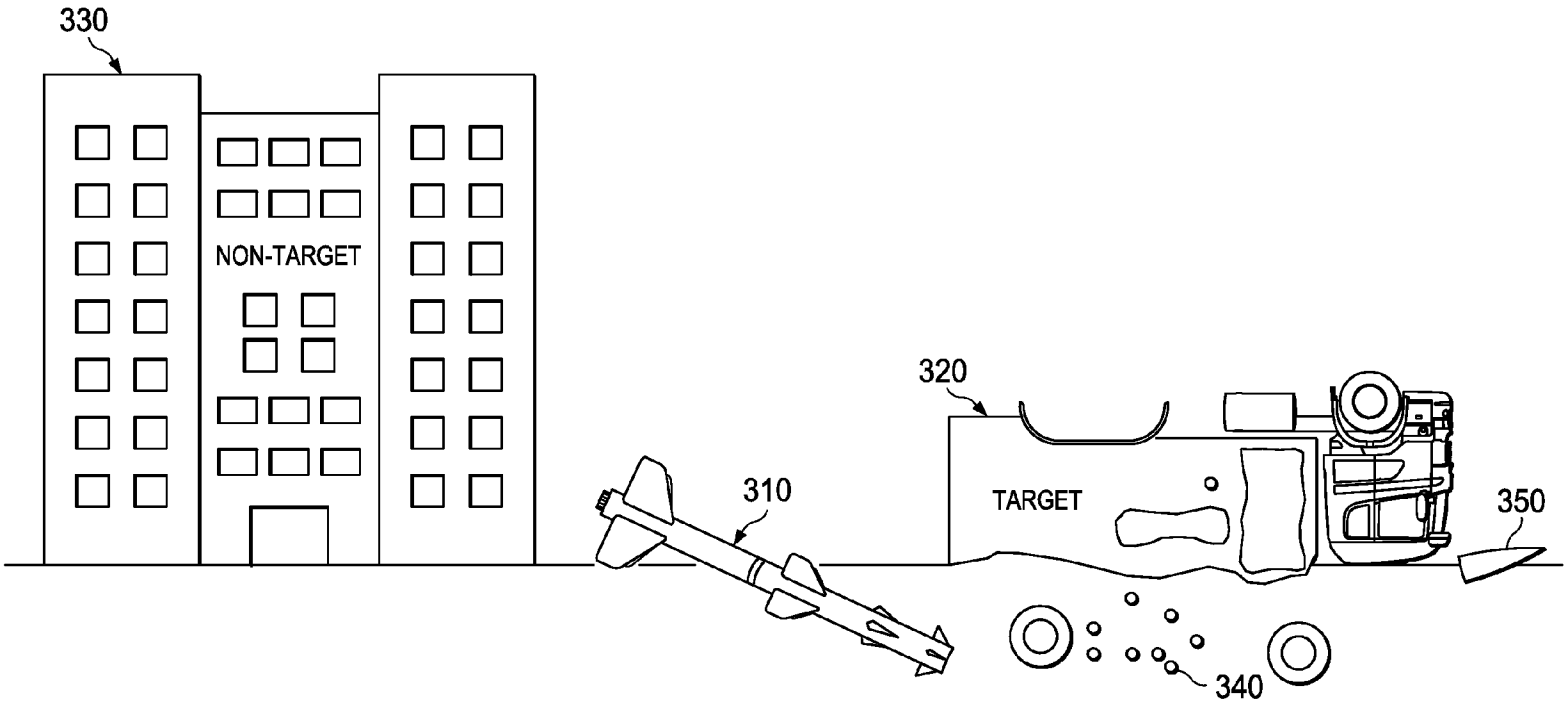

Turning now to FIG. 3D, the target 320 is now destroyed or damaged as depicted by the overturned orientation thereof. Inert and benign elements of the weapon 310 including the destructive elements 340 and guidance member 350 are depicted as expended with little or no residual or harmful energy (e.g., essentially a zero energy state). The destructive elements 340 being non-hazardous materials and containing little, or no, chemical explosives have little, if any, lingering latent capacity to cause collateral damage, latent injury, or hazard to forces passing through, ordnance disposal units, civilians or other personnel. The non-target structure 330 remains undamaged at the conclusion of the detonation of the weapon 310. Thus, the aforementioned illustration of events demonstrate the mission strategy and tactics wherein the rules of engagement provide for the release of the destructive elements 340 from the weapon 310 within an effective range of the target 320. Alternatively, the weapon 310 may remain fully intact so as to impact the target 320 without prior release of the destructive elements 340.

Figure 4A:
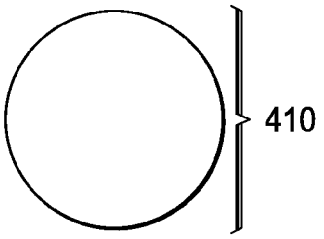
FIGS. 4A-4C illustrate diagrams representing a range of effects due to a selectability of a dispersion event associated with an embodiment of a weapon constructed according to the principles of the present invention.
Figure 4B:
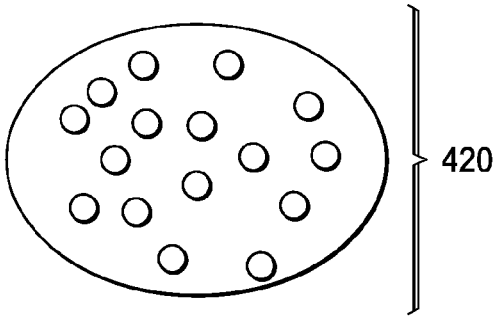
Figure 4C:
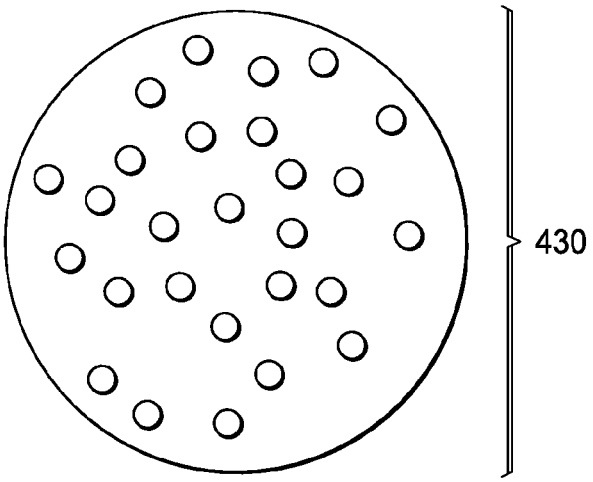

Turning now to FIGS. 4A-4C, illustrated are diagrams representing a range of effects due to a selectability of a dispersion event associated with an embodiment of a weapon constructed according to the principles of the present invention. More specifically, FIG. 4A illustrates that a dispersion event has been suppressed such that destructive elements are not released but are retained within the weapon through impact with the target. The resulting impact pattern is relatively small and may be constrained substantially within a footprint 410 of a diameter of the weapon itself.

With respect to FIG. 4B, a nominally larger impact footprint 420 is illustrated by virtue of selecting a dispersion event to occur at a nominally close range to the target. The destructive elements and remaining portions of the weapon typically fall within the footprint 420 as demonstrated. Regarding FIG. 4C, an even larger footprint 430 is illustrated by virtue of increasing the distance of the dispersion event by the weapon in relation to the target. The impact of the destructive elements and remaining portions of the weapon may not fall within the footprint 430 as demonstrated. In short, by increasing the effective range (see "EFR" in FIG. 3B) of the dispersion event, the footprint of the destructive force may be altered or the impact pattern may be more clearly defined as a result thereof.

Figure 5A:
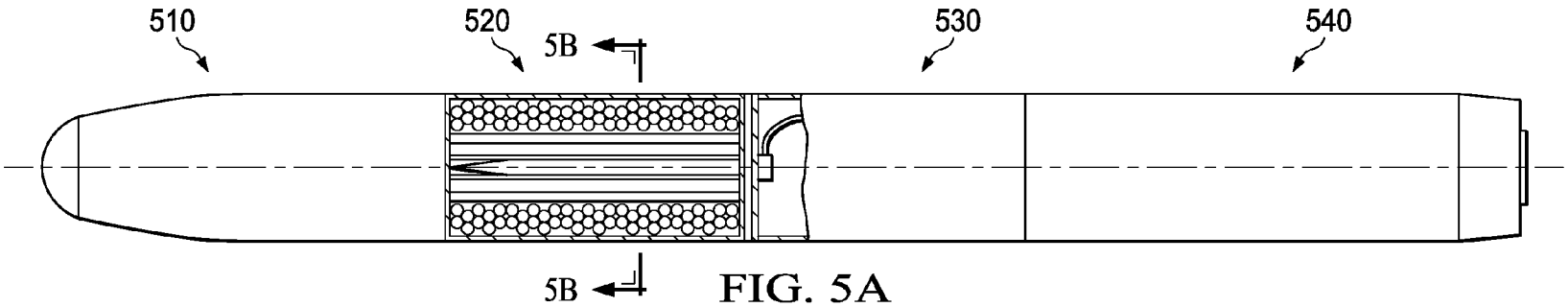
FIGS. 5A-5B illustrate side and cross sectional views, respectively, of an embodiment of a weapon constructed according to the principles of the present invention.
Figure 5B:
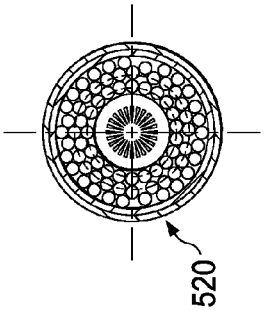

Turning now to FIGS. 5A-5B, illustrated are side and cross sectional views, respectively, of an embodiment of a weapon constructed according to the principles of the present invention. The weapon includes a guidance section 510 including a target sensor (e.g., a laser seeker), guidance and control electronics and logic, and control surfaces for guiding the weapon to a target. The weapon also includes a warhead 520 having destructive elements (preferably formed from a non-explosive material), containing devices, mechanisms and elements to articulate aerodynamic surfaces. The weapon still further includes a control section 530 including system power elements, flight control elements, safe and arm devices and fuzing components coupled to a propulsion section 540 including systems that provide motive power for the weapon aft of the warhead 520.

For instances when the target sensor is a laser seeker, the laser seeker detects the reflected energy from a selected target which is being illuminated by a laser. The laser seeker provides signals so as to drive the control surfaces in a manner such that the weapon is directed to the target. Tail fins (typically located at the aft end of the weapon) provide both stability and lift to the weapon. Modern precision guided weapons such as guided bomb units (e.g., GBU-24) can be precisely guided to a specific target so that the considerable explosive energy such as with combined effects bomblets is often not needed to destroy an intended target. In many instances, kinetic energy discussed herein is more than sufficient to destroy a target, especially when the weapon can be directed with sufficient accuracy to strike a specific designated target.

Additionally, the warhead 520 employable with the weapon may be of a unitary configuration including the destructive elements such as shot and/or at least one dart. The destructive elements may be contained within the unitary warhead by a frangible container in conjunction with other mechanical features, electromagnetic devices, fasteners, explosive bolts or other like construction techniques. In another embodiment, the warhead employable with the weapon may include submunitions including destructive elements. The destructive elements may be contained within the submunitions by a frangible container in conjunction with other mechanical features, electromagnetic devices, fasteners, explosive bolts or other like construction techniques.

As herein described, the term "dart" generally refers to a device having the properties of a large mass-to-cross sectional area (frontal area) ratio and a small diameter-to-length ratio with a fore end thereof that may be shaped to affect aerodynamic efficiency and penetration. The dart may include at least one tail fin at an aft end to affect the aerodynamics of the dart. The dart is generally constructed of non-explosive materials and selected to achieve penetration, fragmentation, or incendiary effects. The dart may include an incendiary material such as a pyrophoric material (e.g., zirconium) therein. The darts may be of substantially different weights, dimensions, materials, shapes, and geometries. Additionally, in warheads employing a plurality of darts, a design and construction of each dart (or ones thereof) may be different. Additionally, the term "shot" generally refers to a solid or hollow spherical, cubic, or other suitably shaped element constructed of non-explosive materials, without the aerodynamic characteristics generally associated with a "dart" as described above. The shot may include an incendiary material such as a pyrophoric material (e.g., zirconium) therein.

The non-explosive materials applied herein are substantially inert in environments that are normal and under benign conditions. Nominally stressing environments such as experienced in normal handling are generally insufficient to cause the selected materials (e.g., tungsten, hardened steel, zirconium, copper, depleted uranium and other like materials) to become destructive in an explosive or incendiary manner. The latent lethal explosive factor is minimal or non-existent. Reactive conditions are predicated on the application of high kinetic energy transfer, a predominantly physical reaction and not on explosive effects, a predominantly chemical reaction.

Figure 6:
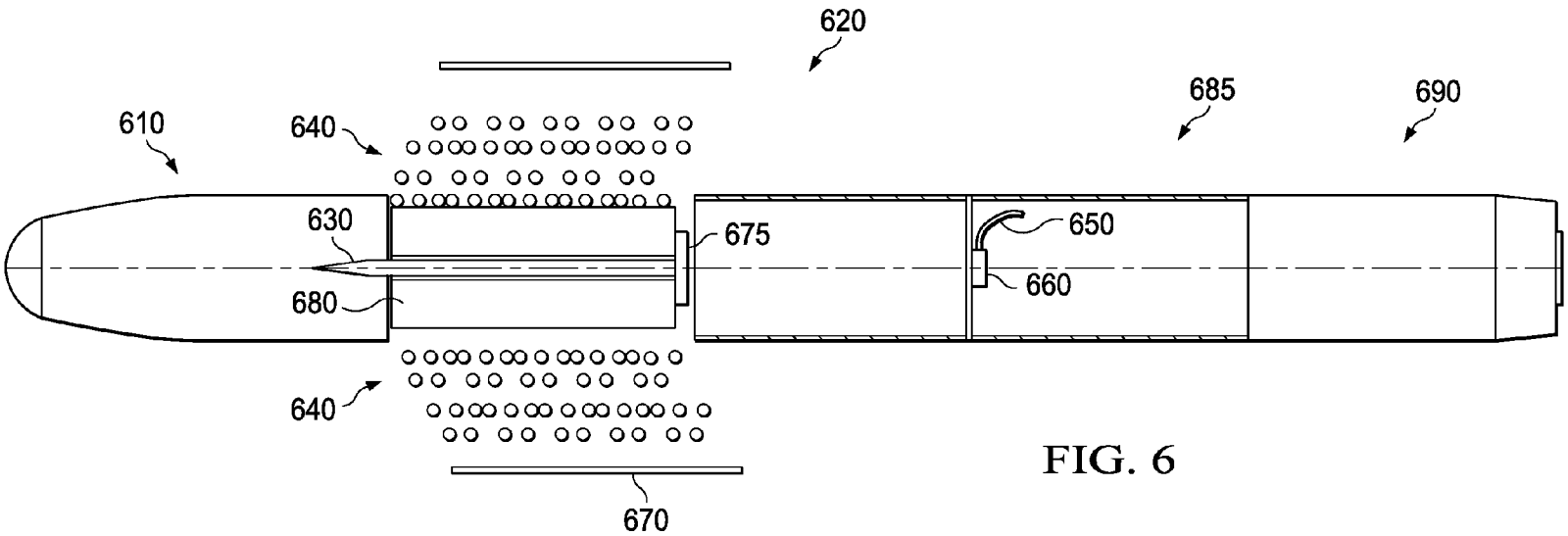
FIG. 6 illustrates a side view of another embodiment of a weapon constructed according to the principles of the present invention.

Turning now to FIG. 6, illustrated is a side view of another embodiment of a weapon constructed according to the principles of the present invention. The weapon includes a guidance section 610 including a target sensor (e.g., a laser seeker), guidance and control electronics and logic, and control surfaces. The weapon also includes a warhead 620 having destructive elements (a dart 630 and a plurality of shot generally designated 640), containing devices, mechanisms and elements to articulate aerodynamic surfaces. The weapon still further includes a control section 685 including system power elements, flight control elements, safe and arm devices and fuzing components coupled to a propulsion section 690 including systems that provide motive power for the weapon aft of the warhead 620.

In the present embodiment, portions of the warhead 620 are expulsed and expanded from the remaining portions of the weapon. Upon a command signal received by way of an umbilical cord 650 and being controlled by an event sequencer 660, a frangible container 670 is expulsed from the weapon. The dart 630 is expulsed by an energy storage device 675 acting on an expulsion bulkhead 680 of the warhead 620. The laterally expanded shot 640 and fragments of the frangible container 670 are expulsed from the warhead 620.

Figure 7A:
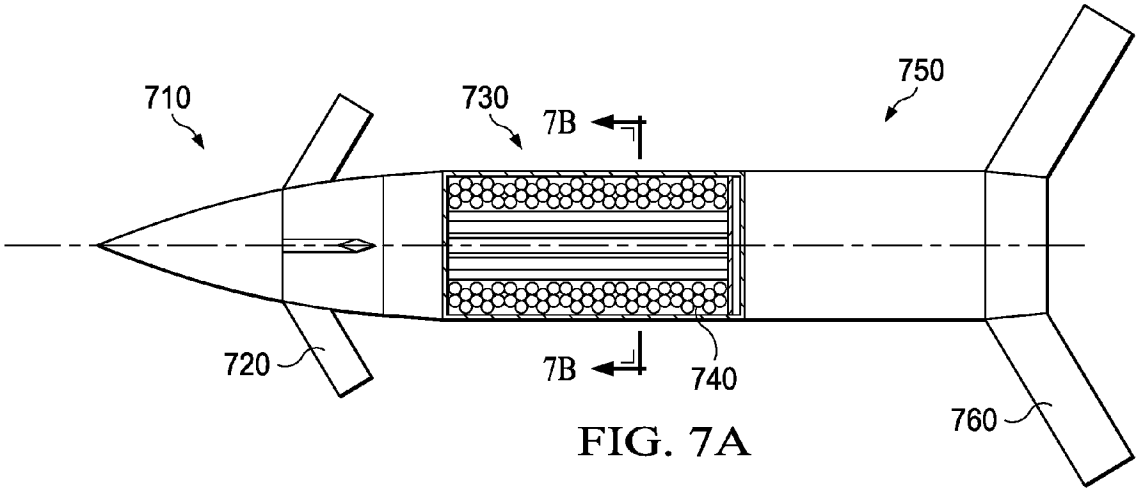
FIGS. 7A-7B illustrate side and cross sectional views, respectively, of another embodiment of a weapon constructed according to the principles of the present invention.
Figure 7B:
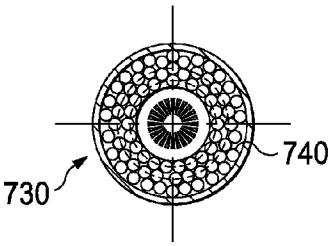

Turning now to FIGS. 7A-7B, illustrated are side and cross sectional views, respectively, of another embodiment of a weapon constructed according to the principles of the present invention. The weapon of the instant embodiment is a projectile style weapon that uses a launching mechanism employable, for instance, with an artillery shell to project the weapon to the intended target.

The weapon includes an ogive shaped guidance section 710 that incorporates aerodynamic surfaces 720. The weapon also includes a warhead 730 with destructive elements embodied in shot (generally designated 740). The remaining portions of the warhead 730 will be described in greater detail as set forth below. The weapon also includes boat tail section 750 aft of the warhead 730 with aerodynamic surfaces 760.

Figure 8A:
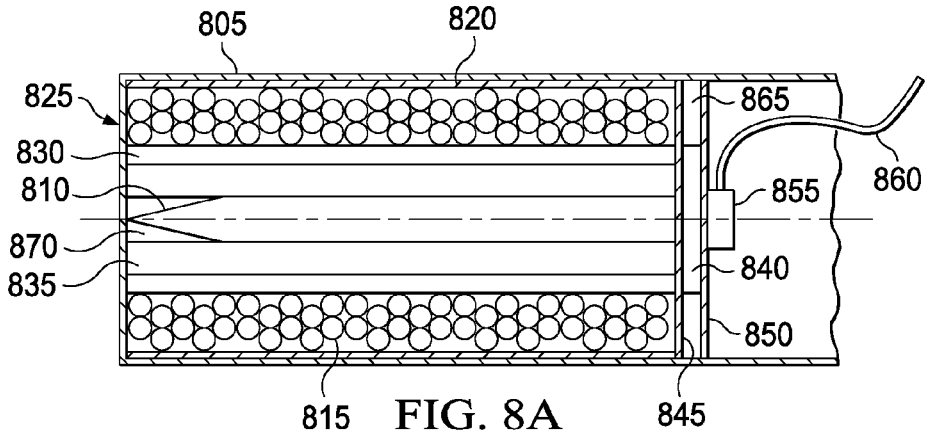
FIGS. 8A-8C illustrate side, and full and partial cross sectional views, respectively, of an embodiment of a warhead constructed according to the principles of the present invention.
Figure 8B:
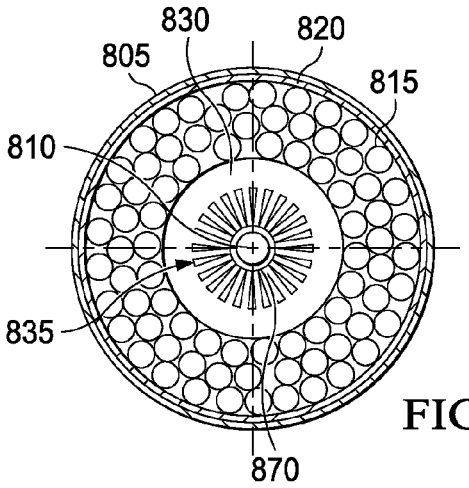
Figure 8C:
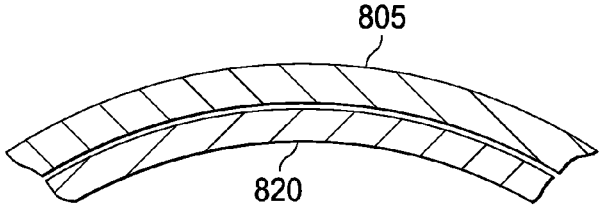

Turning now to FIGS. 8A-8C, illustrated are side, and full and partial cross sectional views, respectively, of an embodiment of a warhead constructed according to the principles of the present invention. The warhead includes an outer casing 805 with destructive elements including a dart 810 and a plurality of shot (generally designated 815) arranged in the annular volume around the dart 810. The destructive elements are located within a frangible container 820 enclosed, at least in part, by a forward (or front) closure 825. The dart 810 and shot 815 may be fabricated from a variety of different materials (including incendiary materials) to obtain specific effects and contain a varied selection of elements, as examples, elements that convert kinetic energy into pyrophoric events, shrapnel, and spalling effects and that cause penetration into and through various substances.

Within the annular volume between the destructive elements, supported by and embedded within a filler 830, is an expandable membrane 835. The filler 830 is a material provided for the purpose of filling void space, packing and protecting elements within the frangible container 820. The filler 830 can be distributed within the warhead to totally or partially encapsulate the shot 815 thereby providing variations in the dispersion patterns thereof. The filler 830 may encapsulate the shot 815, contain chemically explosive elements, be excluded in totality or arranged in a combination thereof to provide variations in the dispersion patterns. The expandable membrane 835 (which may expand under the influence of gas pressure or the like) transfers radial energy and velocity to the shot 815 upon deployment of the frangible container 820 from the outer casing 805 and transfers energy to rupture the frangible container 820.

The frangible container 820 and destructive elements are expelled from the outer casing 805 by suitable energy contained (or stored) in an energy storage device 840 acting in conjunction with an expansion bulkhead 845 to react on the outer casing 805 and an aft bulkhead 850. An expulsion action of the warhead can be effected by propelling the frangible container 820 forward through the front closure 825, laterally through the outer casing 805 or a combination thereof. The expansion bulkhead 845 may also include a piston structure to expel the contents from within the frangible container 820. The energy storage device 840 is activated upon receipt of a signal from an event sequencer 855 that receives data, instructions and information through an umbilical cord 860 from, for instance, a control section of a weapon including the warhead. A degree of violence of expulsion is determined by the volume and characteristics of an expansion chamber 865 (formed between the expansion bulkhead 845 and aft bulkhead 850) and a method of release of the stored energy.

As mentioned above, the event sequencer 855 receives information transmitted within the warhead, interprets the information and transforms the information in a manner to initiate the energy storage device 840 in a selected mode of operation, for a particular sequence at a particular time. The modes of operation include: (a) no action to be executed, (b) expulsion of the frangible container 820 from within the outer casing 805 with no other action, (c) expulsion of the frangible container 820 from an opening in the outer casing 805, and then subsequent expansion to rupture the frangible container 820 and dispense the destructive elements contained therein via an opening in the frangible container 820, and (d) expansion and rupture of the frangible container 820 and outer casing 805 thereby dispensing the destructive elements. The event sequencer 855 can also define an impact pattern of the destructive elements as a function of releasing the destructive elements from the frangible container 820 based on an estimate of a distance from a target. The umbilical cord 860 provides the path for carrying data, instructions and information from within the weapon including the warhead to the event sequencer 855 and for carrying data, instructions and information from the event sequencer 855 to the control section of the weapon. The umbilical cord 860 transmits data, instructions and information via electrical, optical, mechanical or hydraulic energy, or any combination of thereof. In view of the weapon as described above, the weapon incorporates systems and subsystems to ascertain the range or distance to a target and employs methods of executing the dispense events at various distances depending upon impact characteristics desired to impart on the target.

The stored energy for the expulsion action may be of various forms including, but not limited to, expanding gas (e.g., either hot gas developed by burning of combustible propellants or cold gas released from a pressurized container), spring energy, hydraulic energy, rotational forces or aerodynamic pressures. The stored energy may be distributed by a manifold 870 that incorporates features and characteristics to enhance, alter and control the distribution of the stored energy through the frangible container 820. In other words, the expulsion method may also be configured so that the expansion of the expandable membrane 835 can be achieved through alternative methods including the application of mechanical systems, (e.g. springs), hydraulic methods (e.g., liquids), electrical methods (e.g., solenoids), electric-mechanical methods (e.g., motors and linkages), pyrotechnic methods (e.g., explosive charges), aerodynamic pressures and forces (e.g., bellows) and by destructive centrifugal force applied by spinning (e.g., high rotation rates).

Figure 9A:
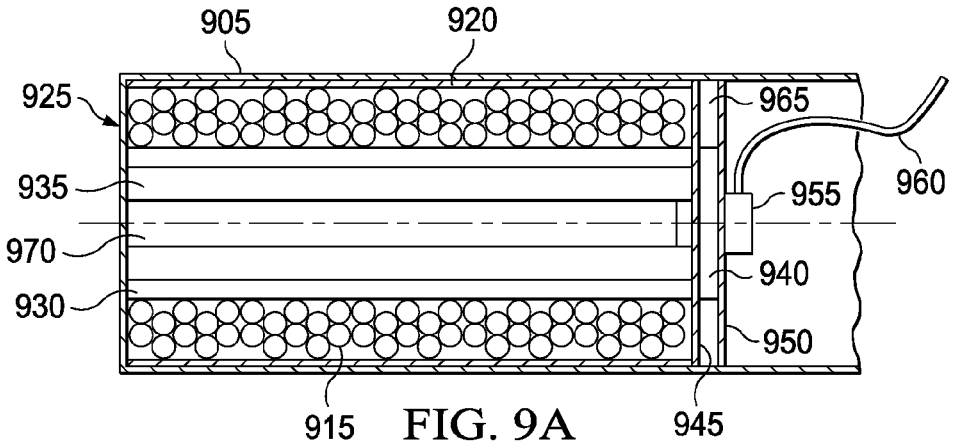
FIGS. 9A-9C illustrate side, and full and partial cross sectional views, respectively, of another embodiment of a warhead constructed according to the principles of the present invention.
Figure 9B:
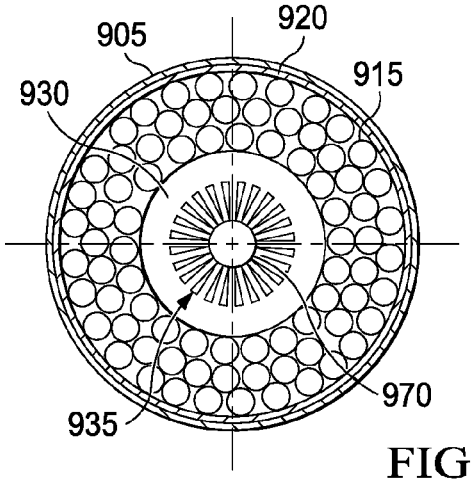
Figure 9C:
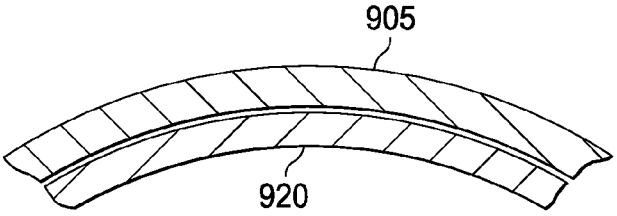

Turning now to FIGS. 9A-9C, illustrated are side, and full and partial cross sectional views, respectively, of another embodiment of a warhead constructed according to the principles of the present invention. The warhead includes an outer casing 905 with destructive elements (e.g., a plurality of shot generally designated 915) located within a frangible container 920 enclosed, at least in part, by a forward (or front) closure 925. The shot 915 may be fabricated from a variety of different materials (including incendiary materials) to obtain specific effects and contain a varied selection of elements such as elements that convert kinetic energy into pyrophoric events, shrapnel, and spalling effects and that cause penetration into and through various substances.

A filler 930 is located in the annular volume around an expandable membrane 935. The filler 930 may encapsulate the shot 915, contain chemically explosive elements, be excluded in totality or arranged in a combination thereof to provide variations in the dispersion patterns thereof. The expandable membrane 935 transfers radial energy and velocity to the shot 915 upon deployment of the frangible container 920 from the outer casing 905 and transfers energy to rupture the frangible container 920.

The frangible container 920 and the shot 915 are expelled from the outer casing 905 by suitable energy contained in an energy storage device 940 acting in conjunction with an expansion bulkhead 945 to react on the outer casing 905 and an aft bulkhead 950. The energy storage device 940 is activated upon receipt of a signal from an event sequencer 955 that receives data, instructions and information through an umbilical cord 960 from, for instance, a control section of a weapon including the warhead. A degree of violence of expulsion is determined by the volume and characteristics of an expansion chamber 965 and a method of release of the stored energy. The stored energy may be distributed by a manifold 970 that incorporates features and characteristics to enhance, alter and control the distribution of the stored energy. The manifold 970 is formed of a suitable structure (e.g., a tube) incorporating features to distribute, for instance, gas pressure in a manner for dispersion control and located typically within a central portion of the frangible container 920.

Figure 10A:
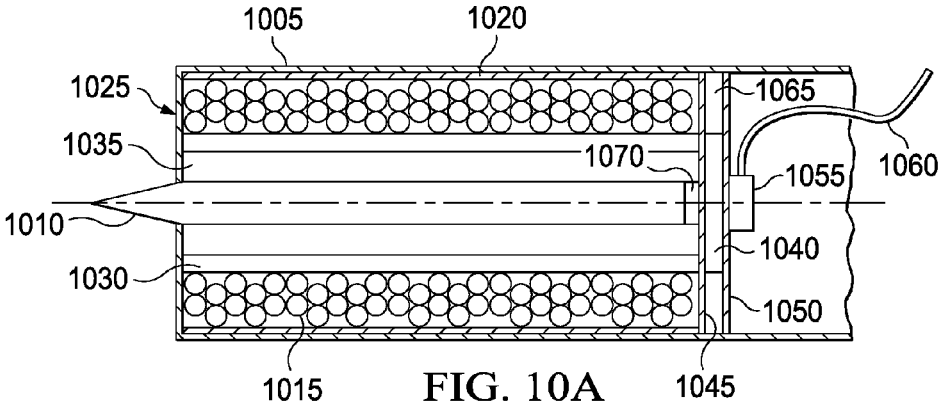
FIGS. 10A-10C illustrate side, and full and partial cross sectional views, respectively, of another embodiment of a warhead constructed according to the principles of the present invention.
Figure 10B:
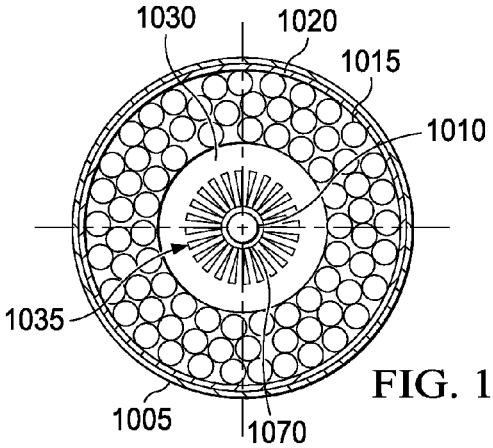
Figure 10C:
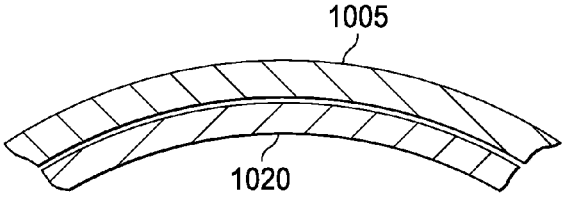

Turning now to FIGS. 10A-10C, illustrated are side, and full and partial cross sectional views, respectively, of another embodiment of a warhead constructed according to the principles of the present invention. The warhead includes an outer casing 1005 with destructive elements including a dart 1010 and a plurality of shot (generally designated 1015) arranged in the annular volume around the dart 1010. The destructive elements are located within a frangible container 1020 enclosed, at least in part, by a forward (or front) closure 1025.

In the illustrated embodiment, the dart 1010 extends beyond the confines of the front closure 1025 of the frangible container 1020. As a result, the dart 1010 provides a greater mass and improved length-to-diameter ratio. These characteristics act to improve conversion of the kinetic energy into penetration efficiency, shrapnel, and spalling.

A filler 1030 is located in the annular volume around an expandable membrane 1035. The filler 1030 may encapsulate the shot 1015, contain chemically explosive elements, be excluded in totality or arranged in a combination thereof to provide variations in the dispersion patterns thereof. The expandable membrane 1035 transfers radial energy and velocity to the shot 1015 upon deployment of the frangible container 1020 from the outer casing 1005 and transfers energy to rupture the frangible container 1020. Of course, the filler 1030 and the expandable membrane 1035, as well as other features of the warhead, may be excluded or substituted for depending on the objective and ultimate use of the warhead.

The frangible container 1020 and destructive elements are expelled from the outer casing 1005 by suitable energy contained in an energy storage device 1040 acting in conjunction with an expansion bulkhead 1045 to react on the outer casing 1005 and an aft bulkhead 1050. The energy storage device 1040 is activated upon receipt of a signal from an event sequencer 1055 that receives data, instructions and information through an umbilical cord 1060 from, for instance, a control section of a weapon including the warhead. A degree of violence of expulsion is determined by the volume and characteristics of an expansion chamber 1065 and a method of release of the stored energy. The stored energy may be distributed by a manifold 1070 that incorporates features and characteristics to enhance, alter and control the distribution of the stored energy. The manifold 1070 is formed of a suitable structure (e.g., a tube) incorporating features to distribute, for instance, gas pressure in a manner for dispersion control and located typically within a central portion of the frangible container 1020.

Figure 11A:
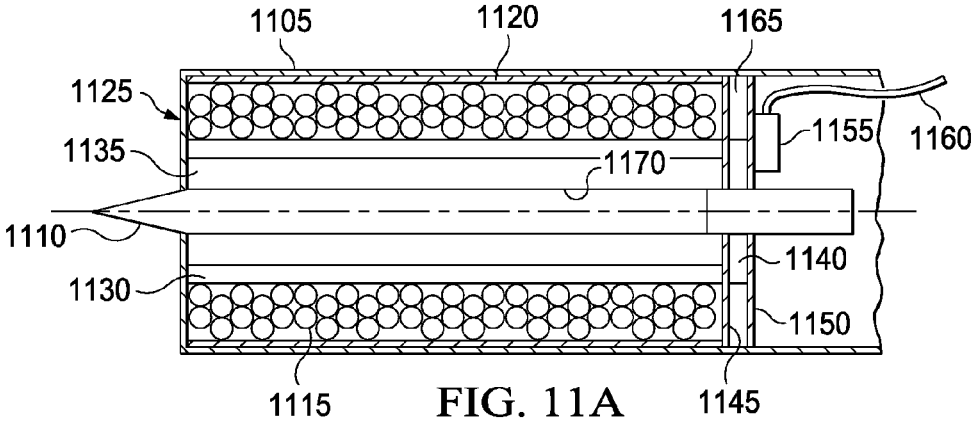
FIGS. 11A-11C illustrate side, and full and partial cross sectional views, respectively, of another embodiment of a warhead constructed according to the principles of the present invention.
Figure 11B:
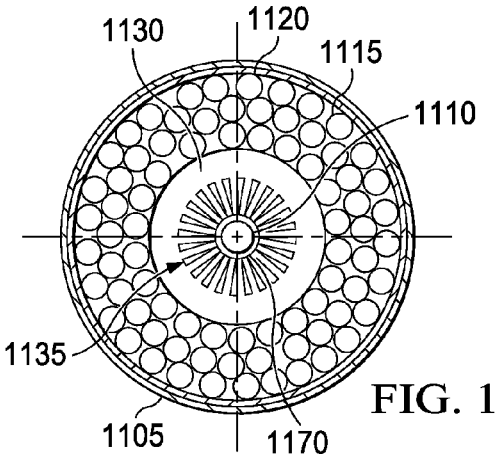
Figure 11C:
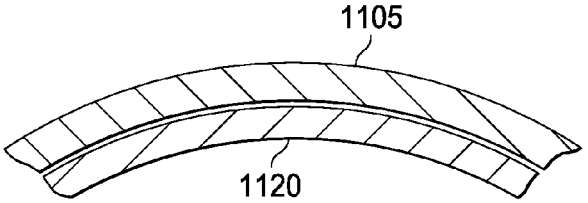

Turning now to FIGS. 11A-11C, illustrated are side, and full and partial cross sectional views, respectively, of another embodiment of a warhead constructed according to the principles of the present invention. The warhead includes an outer casing 1105 with destructive elements including a dart 1110 and a plurality of shot (generally designated 1115) arranged in the annular volume around the dart 1110. The destructive elements are located within a frangible container 1120 enclosed, at least in part, by a forward (or front) closure 1125.

A filler 1130 is located in the annular volume around an expandable membrane 1135. The filler 1130 may encapsulate the shot 1115, contain chemically explosive elements, be excluded in totality or arranged in a combination thereof to provide variations in the dispersion patterns thereof. The expandable membrane 1135 transfers radial energy and velocity to the shot 1115 upon deployment of the frangible container 1120 from the outer casing 1105 and transfers energy to rupture the frangible container 1120.

The frangible container 1120 and destructive elements are expelled from the outer casing 1105 by suitable energy contained in an energy storage device 1140 acting in conjunction with an expansion bulkhead 1145 to react on the outer casing 1105 and an aft bulkhead 1150. The energy storage device 1140 is activated upon receipt of a signal from an event sequencer 1155 that receives data, instructions and information through an umbilical cord 1160 from, for instance, a control section of a weapon including the warhead. A degree of violence of expulsion is determined by the volume and characteristics of an expansion chamber 1165 and a method of release of the stored energy. The stored energy may be distributed by a manifold 1170 that incorporates features and characteristics to enhance, alter and control the distribution of the stored energy. The manifold 1170 is formed of a suitable structure (e.g., a tube) incorporating features to distribute, for instance, gas pressure in a manner for dispersion control and located typically within a central portion of the frangible container 1120.

In the illustrated embodiment, the dart 1110 extends beyond the confines of the front closure 1125 and the aft bulkhead 1150 of the frangible container 1120. The penetration characteristics of the dart 1110 are a function of the length to diameter ratio thereof. The extension of the dart 1110 beyond the aft bulkhead 1150 enhances a variability of the performance characteristics of the dart 1110.

Figure 12A:
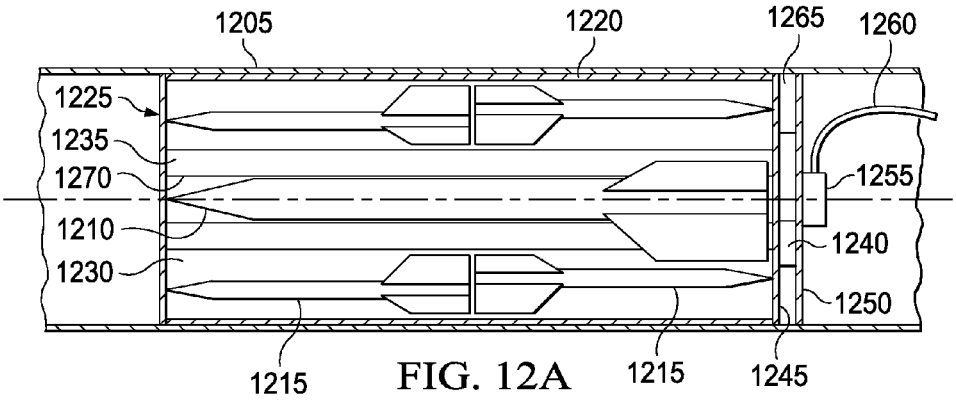
FIGS. 12A-12C illustrate side, and full and partial cross sectional views, respectively, of another embodiment of a warhead constructed according to the principles of the present invention.
Figure 12B:
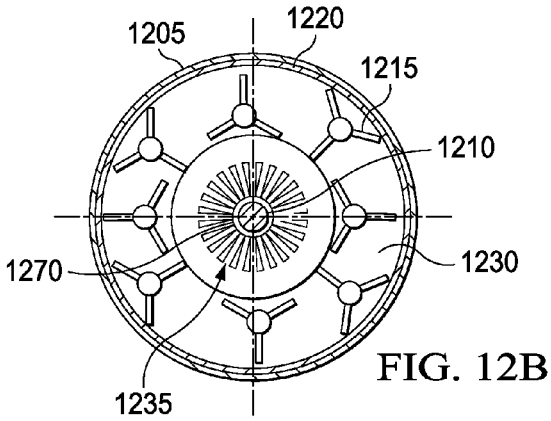
Figure 12C:
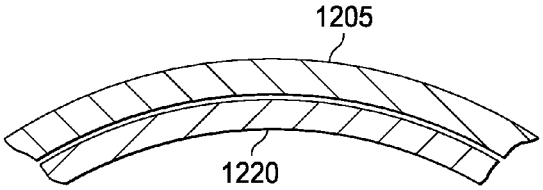

Turning now to FIGS. 12A-12C, illustrated are side, and full and partial cross sectional views, respectively, of another embodiment of a warhead constructed according to the principles of the present invention. The warhead includes an outer casing 1205 with destructive elements including a center dart 1210 and a plurality of peripheral darts (generally designated 1215) arranged in the annular volume around the center dart 1210. The destructive elements are located within a frangible container 1220 enclosed, at least in part, by a forward (or front) closure 1225. As illustrated, a set of the peripheral darts 1215 are generally aligned in a direction of motion of the warhead and another set of the peripheral darts 1215 are generally aligned in opposition to the direction of motion of the warhead (i.e., an opposite orientation from the set of peripheral darts 1215).

A filler 1230 is located in the annular volume around an expandable membrane 1235. The filler 1230 may encapsulate the peripheral darts 1215, contain chemically explosive elements, be excluded in totality or arranged in a combination thereof to provide variations in the dispersion patterns thereof. The expandable membrane 1235 transfers radial energy and velocity to the peripheral darts 1215 upon deployment of the frangible container 1220 from the outer casing 1205 and transfers energy to rupture the frangible container 1220.

The frangible container 1220 and destructive elements are expelled from the outer casing 1205 by suitable energy contained in an energy storage device 1240 acting in conjunction with an expansion bulkhead 1245 to react on the outer casing 1205 and an aft bulkhead 1250. The energy storage device 1240 is activated upon receipt of a signal from an event sequencer 1255 that receives data, instructions and information through an umbilical cord 1260 from, for instance, a control section of a weapon including the warhead. A degree of violence of expulsion is determined by the volume and characteristics of an expansion chamber 1265 and a method of release of the stored energy. The stored energy may be distributed by a manifold 1270 that incorporates features and characteristics to enhance, alter and control the distribution of the stored energy. The manifold 1270 is formed of a suitable structure (e.g., a tube) incorporating features to distribute, for instance, gas pressure in a manner for dispersion control and located typically within a central portion of the frangible container 1220.

Figure 13:
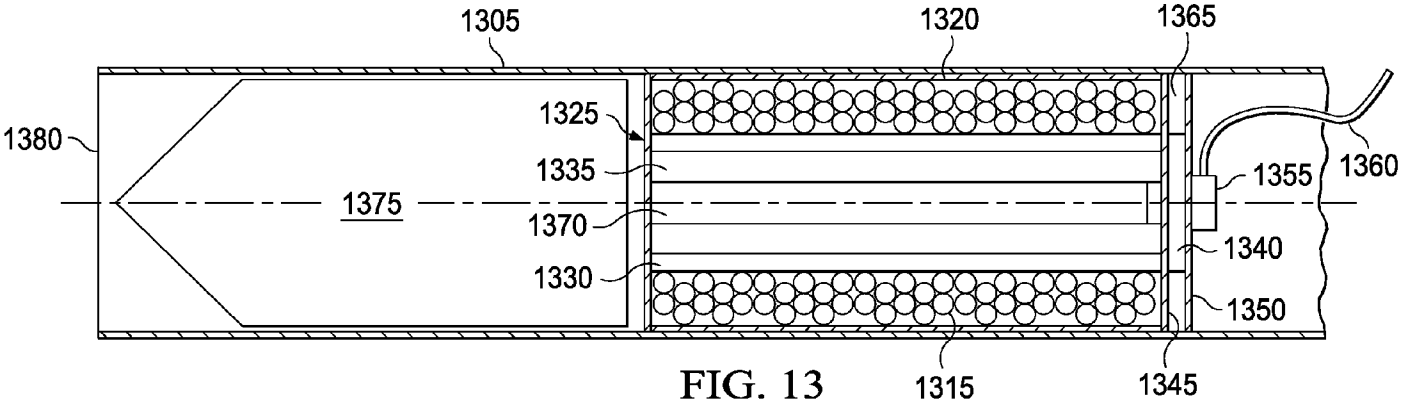
FIG. 13 illustrates a side view of another embodiment of a warhead constructed according to the principles of the present invention.

Turning now to FIG. 13, illustrated is a side view of another embodiment of a warhead constructed according to the principles of the present invention. The warhead includes an outer casing 1305 with destructive elements (e.g., a plurality of shot generally designated 1315) located within a frangible container 1320 enclosed, at least in part, by a forward (or front) closure 1325. The shot 1315 may be fabricated from a variety of different materials to obtain specific effects and contain a varied selection of elements such as elements that convert kinetic energy into pyrophoric events, shrapnel, and spalling effects and that cause penetration into and through various substances.

A filler 1330 is located in the annular volume around an expandable membrane 1335. The filler 1330 may encapsulate the shot 1315, contain chemically explosive elements, be excluded in totality or arranged in a combination thereof to provide variations in the dispersion patterns thereof. The expandable membrane 1335 transfers radial energy and velocity to the shot 1315 upon deployment of the frangible container 1320 from the outer casing 1305 and transfers energy to rupture the frangible container 1320.

The frangible container 1320 and the shot 1315 are expelled from the outer casing 1305 by suitable energy contained in an energy storage device 1340 acting in conjunction with an expansion bulkhead 1345 to react on the outer casing 1305 and an aft bulkhead 1350. The energy storage device 1340 is activated upon receipt of a signal from an event sequencer 1355 that receives data, instructions and information through an umbilical cord 1360 from, for instance, a control section of a weapon including the warhead. A degree of violence of expulsion is determined by the volume and characteristics of an expansion chamber 1365 and a method of release of the stored energy. The stored energy may be distributed by a manifold 1370 that incorporates features and characteristics to enhance, alter and control the distribution of the stored energy. The manifold 1370 is formed of a suitable structure (e.g., a tube) incorporating features to distribute, for instance, gas pressure in a manner for dispersion control and located typically within a central portion of the frangible container 1320.

The warhead also includes another destructive element (in this case, a dart 1375) outside or without the frangible container 1320. The dart 1375 is retained within the warhead with a retaining member 1380. In the illustrated embodiment, the dart 1375 is typically constructed of sufficient mass to act as penetrator. Thus, the dart 1375 may exit an opening in the outer casing 1305 of the warhead to penetrate a target. Additionally, the shot 1315 may be dispensed about the target (via an opening in the frangible container 1320) and may cause a pyrophoric effect, especially if the shot 1315 includes an incendiary material. In conjunction with the frangible container 1320, the dart 1375 is expelled from the outer casing 1305 by suitable energy container in the energy storage device 1340.

Figure 14:
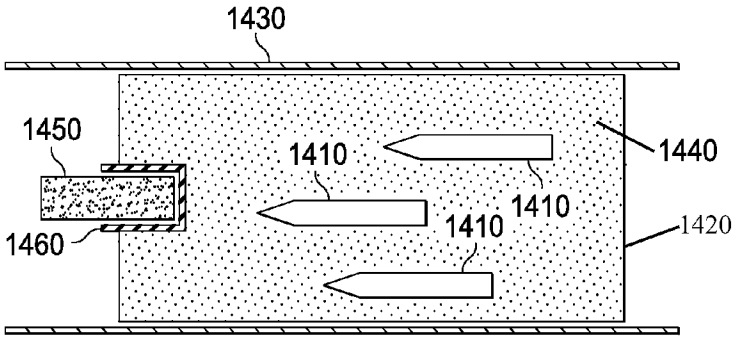
FIG. 14 illustrates a side view of another embodiment of a warhead constructed according to the principles of the present invention.

Turning now to FIG. 14, illustrated is a side view of another embodiment of a warhead constructed according to the principles of the present invention. In the instant embodiment, destructive elements (e.g., a plurality of darts of which one is designated 1410) capable of pyrophoric effects are encapsulated within a frangible container 1420 within an outer casing 1430 of the warhead. The warhead's destructive effects are achieved mainly by chemically derived explosive effects and therefore contains a substantial quantity of chemical explosives 1440 therein. This type of warhead is designed to explode upon actuation of a fuze 1450 seated within a fuze well 1460 and based on contact, timing, altitude, or other means. Failure of the fuze 1450 to properly detonate the chemical explosives 1440 results in a dangerous situation involving unexploded ordnance.

The darts 1410 (which may contain an incendiary material) capable of initiating pyrophoric effects will have substantial kinetic energy as the warhead approaches the target. Should the fuze 1450 fail to detonate, the darts 1410 will continue to move within the chemical explosives 1440 upon impact as the warhead comes to rest thus releasing kinetic energy so as to initiate a pyrophoric effect within the frangible container 1420 and the warhead, in general. This will cause the warhead to undergo either a high level (e.g., explosive) or low level (e.g., incendiary) sequence. In either case, the danger of unexploded ordnance will be dramatically reduced. This invention also comprehends that the darts 1410 will not exercise pyrophoric effects under normal handling and may also be configured into a safe condition that substantially precludes the kinetic energy derived pyrophoric action.

Figure 15:
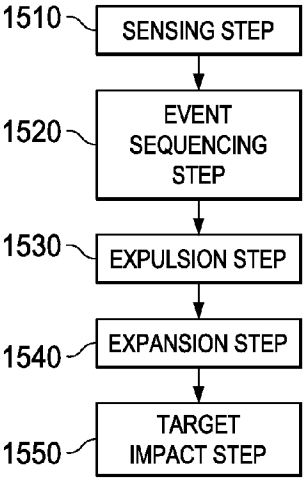
FIG. 15 illustrates a flow diagram demonstrating an exemplary operation of a weapon according to the principles of the present invention.

Turning now to FIG. 15, illustrated is a flow diagram demonstrating an exemplary operation of a weapon according to the principles of the present invention. During a sensing step 1510, a sensor of the weapon detects a target in accordance with, for instance, pre-programmed knowledge based data sets, target information, weapon information, warhead characteristics, safe and arm events, fuzing logic and environmental information. In the target region, sensors and devices detect the target and non-target locations and positions. Command signals including data, instructions, and information contained in the weapon (e.g., a control section) are passed to the warhead via an umbilical cord. The data, instructions, and information contain that knowledge which incorporates the functional mode of the warhead such as safe and arming conditions, fuzing logic, deployment mode and functioning requirements.

The set of information as described above is passed to an event sequencer of the warhead. During an event sequencing step 1520, the kinetic energy warhead characteristics, safe and arm events, fuzing logic, and deployment modes are established and executed therewith. At an instant that all conditions are properly satisfied, the event sequencer passes the proper signals to initiate a fire signal to fuzes for the warhead. In accordance herewith, a functional mode for the warhead is provided including range characteristics and the like.

During an expulsion step 1530, an energy storage device deploys the warhead in a selected mode of operation. While many modes are available, two possible modes will hereinafter be described. In a "No Dispense Mode," all of the components including the destructive elements are retained in the warhead concentrating the total mass of the warhead and weapon within the impact shadow thereof. In a "Dispense Mode," the energy storage device expulses a frangible container from an outer casing of the warhead as a single non-distributed unit. This function does not rupture the frangible container. If no other actions are taken, the warhead impacts the target as a single unit. Other portions of the weapon may also impact the target.

During an expansion step 1540, the energy storage device deploys the warhead in another selected mode. Two possible modes are hereinafter described. As described above in the "No Dispense Mode," all of the components including the destructive elements are retained in the warhead concentrating the total mass of the warhead and weapon within the impact shadow thereof. In the "Dispense Mode," the frangible container is ruptured and a lateral motion is imparted to portions of the warhead causing the destructive elements (e.g., the shot and/or darts) to impact the target as individual elements thereby expanding the area of impact at the target.

During a target impact step 1550, a single impact is registered in the "No Dispense Mode" as the elements are retained within the frangible container and warhead until impact. In the "Dispense Mode," the warhead induces a plurality of impacts on the target with the destructive elements individually or striking the target in partial groups.

Those skilled in the art will recognize that the illustrated sequence is but an illustrative example and that a plurality of logic tests, branching instructions and decision loops may be embedded separately or in combination to augment the methodology. For instance, logic tests, branching instructions and decision loops may interconnect various steps to provide other modes of operation.

Thus, a weapon with a warhead that employs a transfer of kinetic energy into an intended target for purposes of selective destruction with readily attainable and quantifiable advantages has been introduced. The warhead contains little or no explosive materials and fragments into lethal shrapnel and incendiary debris from kinetic energy transfer at impact. The fragments and debris have little or no lethal or incendiary effect when in a benign state. Additionally, the incorporation of the principles of the present invention into an arsenal increases a yield of the arsenal by reducing the number of different weapons therein. Further advantages are achieved when the weapon and accompanying warhead are so arranged as to conform to the mass properties, specifications, and geometry of existing and qualified weapon configurations.

The weapon system of the present invention draws on the advantages of precision guidance and employs kinetic energy to achieve the desired effects. Debris from such a weapon is inert in benign and normal environments within seconds after the event thereby reducing clean up efforts associated with the deployment thereof. Likewise, a weapon according to the principles of the present invention may closely conform to existing payload specifications, which are important to the qualification process, of existing qualified weapons thereby reducing the cost for qualification and acceptance into the arsenal.

The features of the kinetic energy warhead are contained within or as part of a weapon including a missile or projectile. Generally, the application of the kinetic energy warhead is used to advantage in guided weapons, but application to unguided weapons is also of benefit in many cases and comprehended by the present invention. The features of the kinetic energy warhead elements are configured in different manners to produce specific effects for a plurality of intended missions.

The warhead includes the frangible container that may be formed as a part of the primary structure thereof or, alternatively, is formed separately from the warhead as a secondary structure and is packaged within the principal structure thereof. The warhead is, typically, formed of a material that provides the basic strength elements therefor. Unintended or premature failure or separation of the primary structure (such as a premature breakdown of the outer casing) will cause catastrophic failure of the warhead. An example of primary structure of a precision guided missile, for instance, is the fuselage associated with the propulsion section of the weapon.

The secondary structure is the material that forms those elements of the warhead such that a failure of the structure will not necessarily cause catastrophic failure of the weapon. An example of a secondary structure is the material that forms the manifold of the warhead. While the frangible container has been illustrated as a separate structure, those skilled in the art can readily recognize and conceive of structures and methods wherein the inclusion of the frangible container can be an integral portion of the primary structure of the warhead and, ultimately, the weapon as well. Also, while the frangible container has been illustrated as a cylindrical structure, it should be understood that other shapes such as ogive are well within the broad scope of the present invention.

Additionally, exemplary embodiments of the present invention have been illustrated with reference to specific components. Those skilled in the art are aware, however, that components may be substituted (not necessarily with components of the same type) to create desired conditions or accomplish desired results. For instance, multiple components may be substituted for a single component and vice-versa. The principles of the present invention may be applied to a wide variety of weapon systems. Those skilled in the art will recognize that other embodiments of the invention can be incorporated into a weapon that operates on the principle of lateral ejection of a warhead or portions thereof. Absence of a discussion of specific applications employing principles of lateral ejection of the warhead does not preclude that application from failing within the broad scope of the present invention.

Although the present invention has been described in detail, those skilled in the art should understand that they can make various changes, substitutions and alterations herein without departing from the spirit and scope of the invention in its broadest form.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A warhead having an outer casing, including:

a frangible container within said outer casing; and a cylindrical manifold, having a substantially constant diameter, located longitudinally within a central portion of and configured to distribute energy through said frangible container said energy being produced by an energy storage device positioned external to said cylindrical manifold and behind an expansion bulkhead for dispersion control of shot including an incendiary material distributed about said cylindrical manifold.

2. The warhead as recited in claim 1 further comprising a destructive element within said cylindrical manifold.

3. The warhead as recited in claim 1 further comprising a destructive element including a dart within said cylindrical manifold.

4. The warhead as recited in claim 1 further comprising a filler located within said frangible container and at least partially encapsulating said shot.

5. The warhead as recited in claim 1 further comprising a filler containing chemically explosive elements and located within said frangible container and at least partially encapsulating said shot.

6. The warhead as recited in claim 1 further comprising chemical explosives within said frangible container.

7. The warhead as recited in claim 1 wherein said incendiary material includes a pyrophoric material.

8. The warhead as recited in claim 1 wherein said cylindrical manifold is configured to distribute gas pressure for dispersion control.

9. The warhead as recited in claim 1 wherein said cylindrical manifold is a tube.

10. The warhead as recited in claim 1 wherein said frangible container is formed separately from said outer casing of said warhead.

11. The warhead as recited in claim 1 wherein said frangible container is at least partially enclosed by a front closure and an aft bulkhead.

12. The warhead as recited in claim 1 further comprising an expandable membrane configured to transfer radial energy to said shot.

13. The warhead as recited in claim 1 further comprising an expandable membrane configured to transfer energy to rupture said frangible container.

14. The warhead as recited in claim 1 wherein said energy storage device is configured to store energy for expelling said frangible container from said outer casing of said warhead.

15. The warhead as recited in claim 1 wherein said energy storage device is configured to store energy for rupturing said frangible container.

16. The warhead as recited in claim 1 wherein said energy storage device and an expansion chamber are located between an aft bulkhead and said expansion bulkhead of said warhead.

17. The warhead as recited in claim 1 wherein said energy storage device is configured to store energy for rupturing said frangible container and an event sequencer configured to initiate said energy storage device to define an impact pattern of said shot.

18. The warhead as recited in claim 1 further comprising an umbilical cord configured to carry instructions to an event sequencer to initiate a selected mode of operation for said warhead.

19. The warhead as recited in claim 1 wherein said shot is configured to exit said frangible container.

20. The warhead as recited in claim 1 wherein said shot is configured to exit said frangible container to dispense about a target.

* * * * *